US010899572B2

(12) United States Patent
Sakano et al.

(10) Patent No.: US 10,899,572 B2
(45) Date of Patent: Jan. 26, 2021

(54) SHEET PROCESSING APPARATUS AND IMAGE FORMING SYSTEM INCORPORATING THE SAME

(71) Applicants: Koki Sakano, Kanagawa (JP); Shinji Asami, Tokyo (JP); Tomohiro Furuhashi, Kanagawa (JP); Michitaka Suzuki, Kanagawa (JP); Tomomichi Hoshino, Kanagawa (JP); Fumiharu Yoneyama, Kanagawa (JP); Makoto Hidaka, Tokyo (JP); Akira Kunieda, Tokyo (JP); Takuya Morinaga, Tokyo (JP); Yohsuke Haraguchi, Kanagawa (JP)

(72) Inventors: Koki Sakano, Kanagawa (JP); Shinji Asami, Tokyo (JP); Tomohiro Furuhashi, Kanagawa (JP); Michitaka Suzuki, Kanagawa (JP); Tomomichi Hoshino, Kanagawa (JP); Fumiharu Yoneyama, Kanagawa (JP); Makoto Hidaka, Tokyo (JP); Akira Kunieda, Tokyo (JP); Takuya Morinaga, Tokyo (JP); Yohsuke Haraguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 12 days.

(21) Appl. No.: 16/293,811

(22) Filed: Mar. 6, 2019

(65) Prior Publication Data

US 2019/0284008 A1 Sep. 19, 2019

(30) Foreign Application Priority Data

Mar. 19, 2018 (JP) ..... 2018-050353

(51) Int. Cl.

| | |
|---|---|
| ***B65H 37/06*** | (2006.01) |
| ***B42C 1/12*** | (2006.01) |
| ***B65H 39/10*** | (2006.01) |

(52) U.S. Cl.

CPC ..... *B65H 37/06* (2013.01); *B42C 1/12* (2013.01); *B65H 39/10* (2013.01)

(58) Field of Classification Search

CPC ..... B65H 29/64; B65H 2301/3331

(Continued)

(56) References Cited

U.S. PATENT DOCUMENTS 7,562,866 B2 * 7/2009 Hayashi ..... B65H 45/18 270/20.1
7,891,928 B2 * 2/2011 Harada ..... B42C 5/02 412/13

(Continued)

FOREIGN PATENT DOCUMENTS

JP 2003-095527 4/2003
JP 2004-106991 4/2004

(Continued)

*Primary Examiner* — Leslie A Nicholson, III
(74) *Attorney, Agent, or Firm* — Harness, Dickey & Pierce, P.L.C.

(57) ABSTRACT

A sheet processing apparatus includes a folding device to fold a sheet and a fold-enhancing device to press a folded portion of the sheet folded by the folding device to perform enhanced folding processing on the sheet whose trailing edge has exited the folding device.

26 Claims, 16 Drawing Sheets

(58) Field of Classification Search
USPC ..... 270/32, 37, 45, 58.07
See application file for complete search history.

(56) References Cited

U.S. PATENT DOCUMENTS

| | | | | |
|---|---|---|---|---|
| 7,938,388 | B2 * | 5/2011 | Fujii | B65H 37/00 270/45 |
| 8,109,495 | B2 * | 2/2012 | Kikkawa | B65H 45/18 270/45 |
| 8,459,631 | B2 * | 6/2013 | Ishikawa | B42B 4/00 270/51 |
| 8,596,631 | B2 * | 12/2013 | Ishikawa | B42B 4/00 270/51 |
| 9,365,386 | B2 * | 6/2016 | Ando | B65H 45/12 |
| 9,555,998 | B2 * | 1/2017 | Watanabe | B65H 45/20 |
| 9,637,342 | B2 * | 5/2017 | Hari | B65H 45/30 |
| 9,938,110 | B2 * | 4/2018 | Awano | B65H 45/18 |
| 9,994,414 | B2 * | 6/2018 | Hari | B65H 29/60 |
| 10,105,968 | B2 * | 10/2018 | Iwata | B41J 11/0045 |
| 10,363,757 | B2 * | 7/2019 | Iwata | B41J 11/04 |
| 2004/0070133 | A1 | 4/2004 | Yamada et al. | |
| 2014/0203486 | A1 | 7/2014 | Sugiyama et al. | |
| 2014/0203487 | A1 | 7/2014 | Hoshino et al. | |
| 2014/0203488 | A1 | 7/2014 | Hidaka et al. | |
| 2014/0206516 | A1 | 7/2014 | Hata et al. | |
| 2014/0206517 | A1 | 7/2014 | Kikuchi et al. | |
| 2014/0206518 | A1 | 7/2014 | Hidaka et al. | |
| 2014/0206519 | A1 | 7/2014 | Hoshino et al. | |
| 2014/0213425 | A1 | 7/2014 | Sugiyama et al. | |
| 2014/0336031 | A1 | 11/2014 | Suzuki et al. | |
| 2014/0364295 | A1 | 12/2014 | Watanabe et al. | |
| 2015/0031520 | A1 | 1/2015 | Nakada et al. | |
| 2015/0225201 | A1 | 8/2015 | Watanabe et al. | |
| 2015/0266697 | A1 | 9/2015 | Saito et al. | |
| 2016/0060072 | A1 | 3/2016 | Watanabe et al. | |
| 2016/0068359 | A1 | 3/2016 | Suzuki et al. | |
| 2016/0114999 | A1 | 4/2016 | Suzuki et al. | |
| 2016/0115000 | A1 | 4/2016 | Sugiyama et al. | |
| 2018/0201466 | A1 | 7/2018 | Saito et al. | |
| 2018/0236744 | A1 | 8/2018 | Suzuki et al. | |
| 2018/0257900 | A1 | 9/2018 | Suzuki et al. | |

FOREIGN PATENT DOCUMENTS

| | | |
|---|---|---|
| JP | 2011-143975 | 7/2011 |
| JP | 2012-171727 | 9/2012 |
| JP | 2015-117133 | 6/2015 |

* cited by examiner

SHEET PROCESSING APPARATUS AND IMAGE FORMING SYSTEM INCORPORATING THE SAME

CROSS-REFERENCE TO RELATED APPLICATIONS

This patent application is based on and claims priority pursuant to 35 U.S.C. § 119 to Japanese Patent Application No. 2018-050353, filed on Mar. 19, 2018, in the Japanese Patent Office, the entire disclosure of which is hereby incorporated by reference herein.

BACKGROUND

Technical Field

This disclosure relates to a sheet processing apparatus and an image forming system incorporating the sheet processing apparatus.

Background Art

A sheet processing apparatus is known that includes a folding device to fold a sheet or a sheet bundle and a fold-enhancing device to perform enhanced folding processing, in which the fold-enhancing device presses a folded portion of the sheet or the sheet bundle that is folded by the folding device.

SUMMARY

This specification describes an improved sheet processing apparatus that includes a folding device to fold a sheet and a fold-enhancing device to press a folded portion of the sheet folded by the folding device to perform enhanced folding processing on the sheet whose trailing edge has exited the folding device.

This specification further describes an improved sheet processing apparatus that includes an overlay device to overlay a plurality of sheets sent sequentially and form a sheet bundle, a folding device to fold the sheet bundle sent from the overlay device, and a fold-enhancing device to press a folded portion of the sheet bundle folded by the folding device. The overlay device includes a holder split off from a sheet conveyance path and conveys a preceding sheet in a predetermined direction, subsequently conveys the preceding sheet in a direction opposite to the predetermined direction and holds the preceding sheet in the holder. The folding device performs the enhanced folding process on the sheet bundle whose trailing edges are out of the overlay device.

This specification still further describes an improved sheet processing apparatus that includes an overlay device to overlay a plurality of sheets sent sequentially and form a sheet bundle, a folding device to fold the sheet bundle sent from the overlay device, an fold-enhancing device to press the folded portion of the sheet bundle processed by the folding device to perform enhanced folding processing, and circuitry to control the overlay device, the folding device, and the fold-enhancing device. The overlay device includes a holder branching from a sheet conveyance path. The folding device includes a conveyor to convey the sheet bundle, a reversible conveyer rotatable in reverse to convey the sheet bundle conveyed from the conveyer, and a folded portion former to form a folded portion on the sheet bundle. The circuitry controls the reversible conveyer to convey the sheet bundle held by the conveyer and the reversible conveyer to the conveyer, bend the sheet bundle, and enter a bent portion of the sheet bundle into the folded portion former to fold the sheet bundle, the circuitry to control the overlay device to convey a preceding sheet to the folding device by a predetermined amount in a predetermined direction, subsequently convey the preceding sheet in a direction opposite to the predetermined direction, and convey the preceding sheet to the holder to hold the preceding sheet in the holder, and the circuitry controls the fold-enhancing device to perform the enhanced folding process on the sheet bundle after a trailing edge of the sheet bundle has exited a portion in which the preceding sheet exists in the folding device when the overlay device overlays a plurality of sheets.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
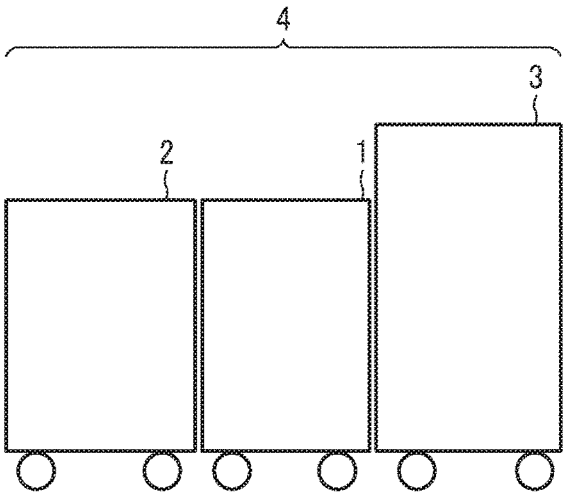
FIG. 1 is a schematic diagram illustrating a system configuration of an image forming system including an image forming apparatus and a plurality of sheet processing apparatuses according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all the components or elements described in the embodiments of this disclosure are not necessarily indispensable.

Referring now to the drawings, embodiments of the present disclosure are described below. In the drawings illustrating the following embodiments, the same reference codes are allocated to elements having the same function or shape and redundant descriptions thereof are omitted below.

FIG. 1 is a schematic diagram illustrating a system configuration of an image forming system 4 according to an embodiment of the present disclosure, including an image forming apparatus and a plurality of sheet processing apparatuses. The image forming system 4 in the present embodiment includes a folding apparatus 1 and a post-processing apparatus 2, each of which serves as the sheet processing apparatus, provided in this order at later stages of the image forming apparatus 3, as illustrated in FIG. 1.

The image forming apparatus 3 forms an image on a sheet based on image data that is input to the image forming apparatus 3 or obtained by scanning. The image forming apparatus 3 may be, for instance, a copier, a printer, a facsimile machine, or a multifunction peripheral having at least two functions of the foregoing machines. The image forming apparatus 3 may use any known image forming method, such as electrophotography or droplet discharge. The image forming apparatus 3 in the present embodiment is a copier using the electrophotography.

Examples of the post-processing apparatus 2 include a punch apparatus that punches a hole in the sheet, a sheet binding apparatus in which a stapler or the like binds sheets and make a sheet bundle, and a sorter that sorts and ejects a sheet on which an image formed into each of a plurality of ejection trays.

Figure 2:
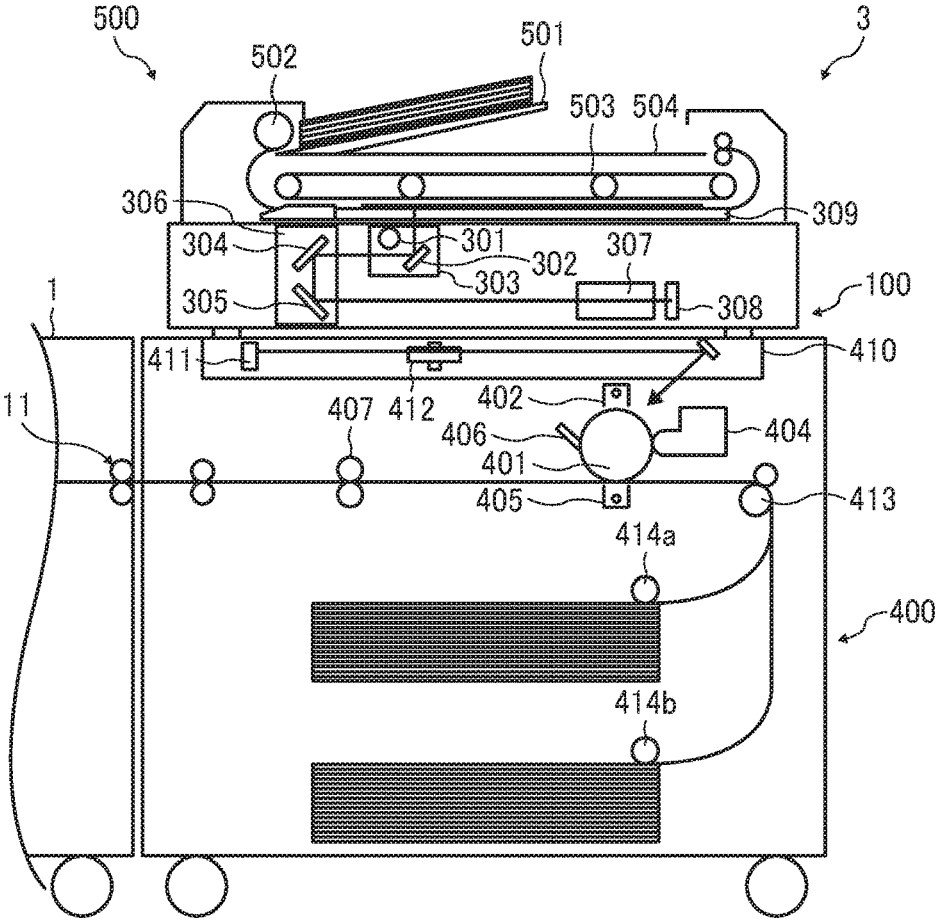
FIG. 2 is a schematic configuration diagram of the image forming apparatus provided in the image forming system of FIG. 1.

FIG. 2 is a schematic configuration diagram of the image forming apparatus 3 provided in the image forming system 4 according to the present embodiment.

In an image forming apparatus main body 400, feeding cassettes to store sheets serving as recording media are disposed below an image forming section. After the sheet stored in the feeding cassettes is fed by the feeding roller 414*a* or 414*b*, the sheet is conveyed upward along a predetermined conveyance path. Then the sheet reaches a pair of registration rollers 413.

The image forming section includes a photoconductor drum 401 as an image bearer, a charger 402, an exposure device 410, a developing device 404, a transfer device 405, and a cleaner 406.

The charger 402 uniformly charges a surface of the photoconductor drum 401. The exposure device 410 serving as a latent image forming device forms an electrostatic latent image on the photoconductor drum 401 based on image data read by a scanner 100. The developing device 404 adheres toner to the electrostatic latent image formed on the photoconductor drum 401 to form a visible image as a toner image. The transfer device 405 transfers the toner image from the photoconductor drum 401 onto the sheet. The cleaner 406 removes toner remaining on the photoconductor drum 401 after the transfer.

On the downstream side of the image forming section in a sheet conveyance direction, a fixing device 407 to fix the toner image on the sheet is disposed.

The exposure device 410 includes a laser unit 411 to emit a laser beam based on the image data under a control of a controller and a polygon mirror 412 to scan the laser beam from the laser unit 411 in a rotation axis direction of the photoconductor drum 401 which is called a main scanning direction.

An automatic document feeder (ADF) 500 is mounted on the scanner 100. The automatic document feeder (ADF) 500 includes a platen 501, a separation and feed roller 502, an original conveyor belt 503, and an original ejection tray 504.

When the automatic document feeder (ADF) 500 receives an instruction to start scanning originals placed on the platen 501, the separation and feed roller 502 feeds the originals one by one from the platen 501 to the original conveyor belt 503. The original conveyor belt 503 moves the originals onto a platen glass 309 on which each of the originals temporally stops.

Then, the scanner 100 reads the image data of the original temporarily stopped on the platen glass 309. Thereafter, the original conveyor belt 503 resumes conveyance of the original to eject the original onto the original ejection tray 504.

A more detailed description is now provided of an image reading operation and an image forming operation.

In addition to the platen glass 309, the scanner 100 includes a first carrier 303, a light source 301 and a mirror 302 provided on the first carrier 303, a second carrier 306, mirrors 304 and 305 provided on the second carrier 306, a lens 307, and a charge coupled device (CCD) 308. The light source 301 is lighted when the automatic document feeder (ADF) 500 conveys the original onto the platen glass 309 or when a user places an original on the platen glass 309 and directs the image forming apparatus to start copying via an operation panel. In the meantime, the first carrier 303 and the second carriers 306 move along a guide rail.

The light source 301 emits light to the original positioned on the platen glass 309. Reflected light from the original is guided to the CCD 308 via the mirror 302, the mirrors 304 and 305, and the lens 307. The CCD 308 receives the reflected light and reads the image data of the original. The image data is converted from analog data to digital data by an analog-to-digital (A/D) converter. The digital data is sent from a data output unit to the controller in the image forming apparatus main body 400.

On the other hand, the image forming apparatus main body 400 starts to drive the photoconductor drum 401, and after a rotation speed of the photoconductor drum 401 reaches a predetermined speed, the charger 402 uniformly charges the surface of the photoconductor drum 401. The exposure device 410 forms the electrostatic latent image on the charged surface of the photoconductor drum 401 based on the image data read by the scanner 100.

Thereafter, the developing device 404 develops the electrostatic latent image on the surface of the photoconductor drum 401 into a toner image. In the meantime, the feeding roller 414*a* or 414*b* feeds the sheet stored in the feeding cassette, and the pair of registration rollers 413 temporarily stops the sheet.

The pair of registration rollers 413 feeds the sheet to a transfer portion opposed to the transfer device 405 when a leading edge of the toner image formed on the surface of the photoconductor drum 401 reaches the transfer portion. While the sheet passes through the transfer portion, a transfer electric field transfers the toner image formed on the surface of the photoconductor drum 401 onto the sheet.

The sheet on which the toner image is transferred is conveyed to the fixing device 407, subjected to a fixing process by the fixing device 407, and then ejected to the folding apparatus 1 at the subsequent stage. The cleaner 406 removes residual toner which is not transferred onto the sheet at the transfer portion and remains on the surface of the photoconductor drum 401.

Figure 3:
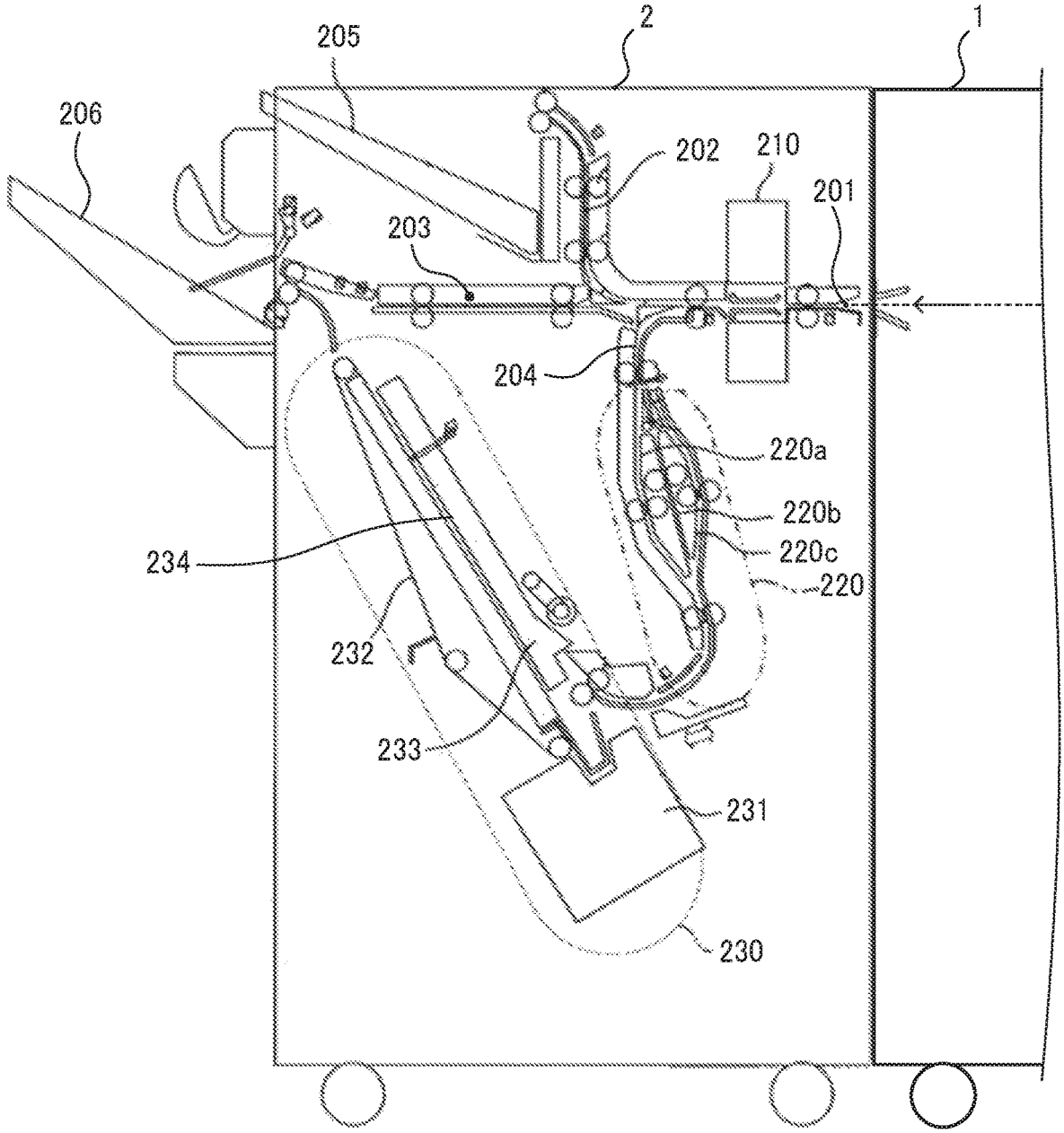
FIG. 3 is a schematic configuration diagram of a post-processing apparatus provided in the image forming system of FIG. 1.

FIG. 3 is a schematic configuration diagram of the post-processing apparatus 2 provided in the image forming system 4 according to the embodiment.

The post-processing apparatus 2 includes an introduction path 201 to receive the sheet from the folding apparatus 1 and three paths diverging from the introduction path 201, that is, a first ejection path 202 to eject the sheet to an upper tray 205, a second ejection path 203 to eject the sheet to a shift tray 206, and a conveyance path 204 to convey the sheet to a sheet binding device 230. On the introduction path 201, a punching device 210 is disposed to puncture a punch hole in the sheet. The punching device 210 punctures the punch hole at a predetermined position in a folded sheet, a folded sheet bundle, and a single sheet that has been conveyed without being folded, which are ejected from the folding apparatus 1.

On the conveyance path 204, an overlay device 220 is disposed. The overlay device 220 includes three conveyance paths 220*a*, 220*b*, and 220*c*. Sorting the sheets to each conveyance path and temporarily waiting on each conveyance path allows up to three sheets to be overlaid and conveyed.

The sheet binding device 230 includes a processing tray 233, a jogger fence 234 to align a plurality of sheets (that is a sheet bundle) in the processing tray 233, a stapler unit 231 to perform binding processing on the sheet bundle in the processing tray 233, and a conveyance belt 232 to convey the sheet bundle subjected to binding processing toward the shift tray 206.

When the predetermined number of sheets which are folded or not folded is conveyed to the processing tray 233, the jogger fence 234 performs the alignment processing on the sheet bundle in the processing tray 233. Then, after the stapler unit 231 performs the binding processing on the sheet bundle in the processing tray 233, the conveyance belt 232 conveys the bound sheet bundle, and the bound sheet bundle is ejected to the shift tray 206.

Figure 4:
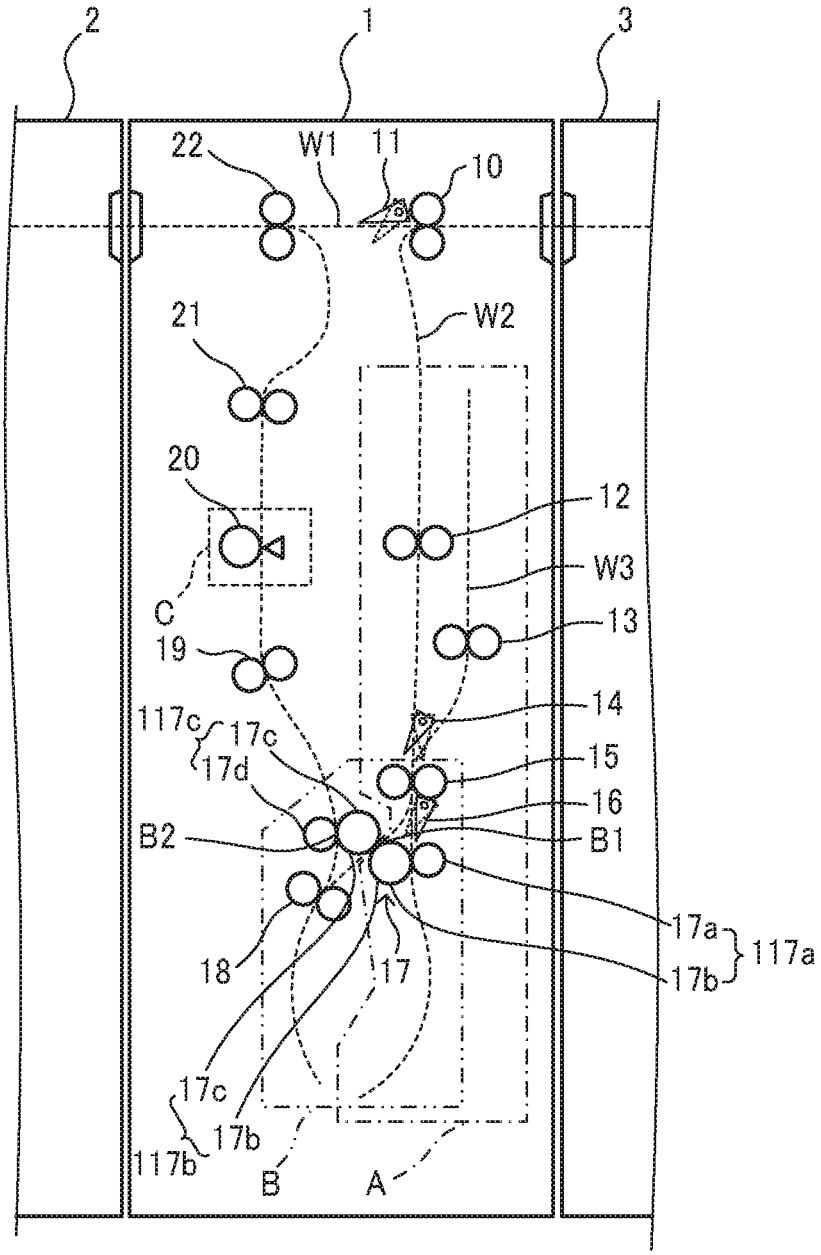
FIG. 4 is a schematic configuration diagram of a folding apparatus provided in the image forming system of FIG. 1.

FIG. 4 is a schematic configuration diagram of a folding apparatus 1 provided in the image forming system 4 according to the embodiment.

As illustrated in FIG. 4, the folding apparatus 1 includes an entry roller pair 10 to convey the sheet received from the image forming apparatus 3. On the downstream side from the entry roller pair 10, the sheet conveyance path is divided into a folding processing conveyance path W2 to convey the sheet and perform the folding processing and a through conveyance path W1 to convey the sheet without the folding processing. A first bifurcating claw 11 is disposed at a fork between the folding processing conveyance path W2 and the through conveyance path W1. The first bifurcating claw 11 guides the sheet to the through conveyance path W1 or the folding processing conveyance path W2.

The folding processing conveyance path W2 includes an overlay section A to overlap a plurality of sheets, a folding section B to fold one sheet or sheets overlaid in the overlay section A, and an enhanced folding section C in which the folded sheet is additionally folded.

The overlay section A includes a registration roller pair 15, a first conveyance roller pair 117*a* including a first pressing roller 17*a* in a folding mechanism 17 described later and a first folding roller 17*b*, and a conveyance roller pair 12 to convey the sheet toward the registration roller pair 15. The overlay section A also includes a switchback conveyance path W3 that branches from the folding processing conveyance path W2 between the conveyance roller pair 12 and the registration roller pair 15 and conveys the sheet conveyed in a reverse direction by the registration roller pair 15, and a switchback conveying roller pair 13 disposed in the switchback conveyance path W3. The overlay section A also includes a second bifurcating claw 14 disposed at a fork between the switchback conveyance path W3 and the folding processing conveyance path W2 from the conveyance roller pair 12 to the registration roller pair 15 to guide the sheet conveyed in the reverse direction toward the switchback conveyance path W3.

The folding section B is disposed downstream of the overlay section A. The folding section B includes the registration roller pair 15, the folding mechanism 17, and a second conveyance roller pair 18. The folding mechanism 17 includes the first folding roller 17*b*, the first pressing roller 17*a* which contacts the first folding roller 17*b* to switch back the sheet, a second folding roller 17*c* which contacts the first folding roller 17*b* to form a first folding nip B1, and a second pressing roller 17*d* which contacts the second folding roller 17*c* to form a second folding nip 132. The driving force is transmitted to one of the plurality of rollers included in the folding mechanism 17, and the other rollers are driven to rotate.

A third bifurcating claw 16 is disposed downstream of the registration roller pair 15 to guide the sheet to the first folding nip B1 or the nip between the first folding roller 17*b* and the first pressing roller 17*a*.

On the downstream side of the folding section B, the enhanced folding section C is disposed. The enhanced folding section C includes an enhanced folding roller 20. The enhanced folding roller 20 has a pressing convex portion, and the pressing convex portion presses the folded portion of the sheet, and the folded portion of the sheet is additionally folded.

Figure 5:
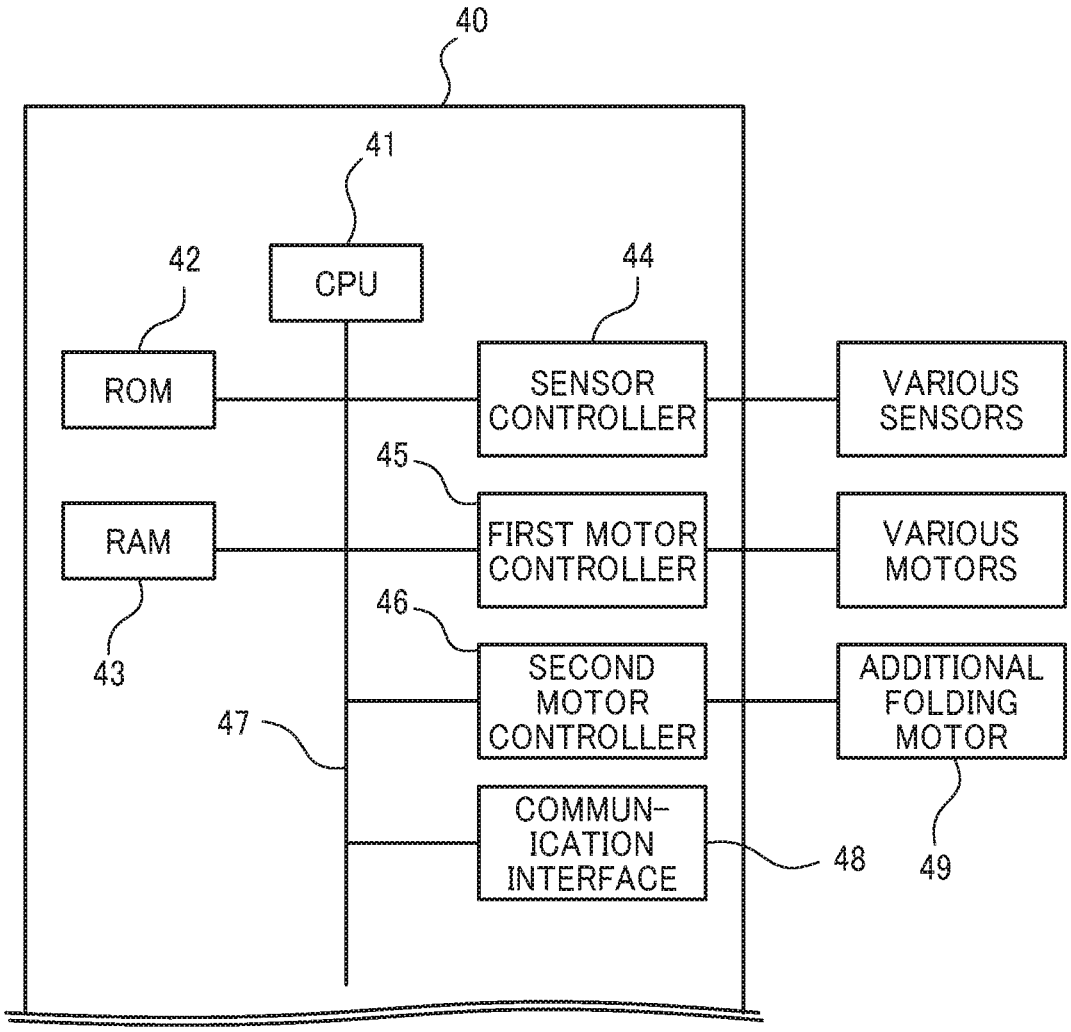
FIG. 5 is a block diagram of an example of a control circuit to control e folding apparatus of the image forming system of FIG. 1.

FIG. 5 is a block diagram of an example of a control circuit to control the folding apparatus 1 in the image forming system 4.

The controller 40 to control the folding apparatus 1 includes a Central Processing Unit (CPU) 41, a Read Only Memory (ROM) 42, a Random Access Memory (RAM) 43, a sensor controller 44 to control various sensors such as a paper detection sensor disposed in the folding apparatus 1, a first motor controller 45 to control a plurality of conveyance motors which convey the sheet in the folding apparatus 1, a second motor controller 46 to control the enhanced folding motor 49 that drives the enhanced folding roller 20, and a communication interface 48.

These components are mutually electrically coupled via a bus line 47 such as an address bus or a data bus. The communication interface 48 communicates with the image forming apparatus 3 and the post-processing apparatus 2 in FIG. 1 and exchanges data necessary for control. The ROM 42 stores data and programs executed by the CPU 41. The CPU 41 executes a computer readable program stored in the ROM 42 to control the folding apparatus 1. The RAM 43 temporarily stores data when the CPU 41 executes the program.

FIGS. 6A to 6F are explanatory diagrams illustrating the sheet overlay operation executed by the overlay section A of the folding apparatus 1.

Figure 6A:
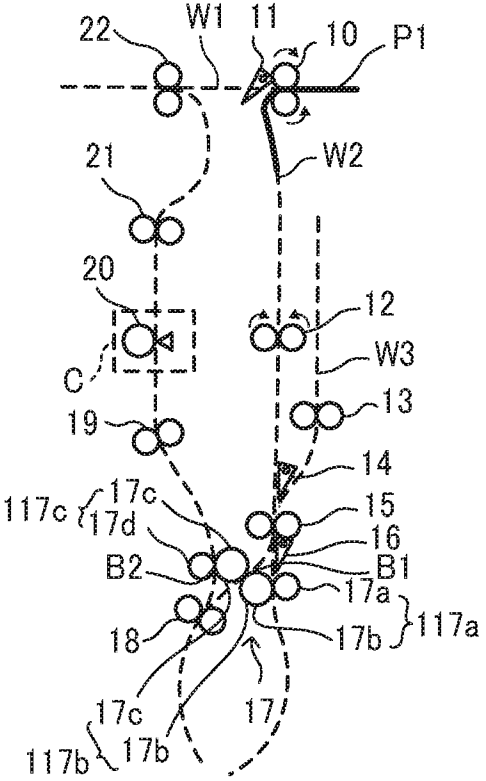
FIGS. 6A to 6F are explanatory diagrams illustrating a sheet overlay operation executed by an overlay section of the folding apparatus.

As illustrated in FIG. 6A, the entry roller pair 16 conveys the first sheet P1 to the folding processing conveyance path W2. A leading edge of the first sheet P1 conveyed to the folding processing conveyance path W2 contacts the registration roller pair 15 to correct the skew of the first sheet. However, this skew correction may not be performed.

Figure 6B:
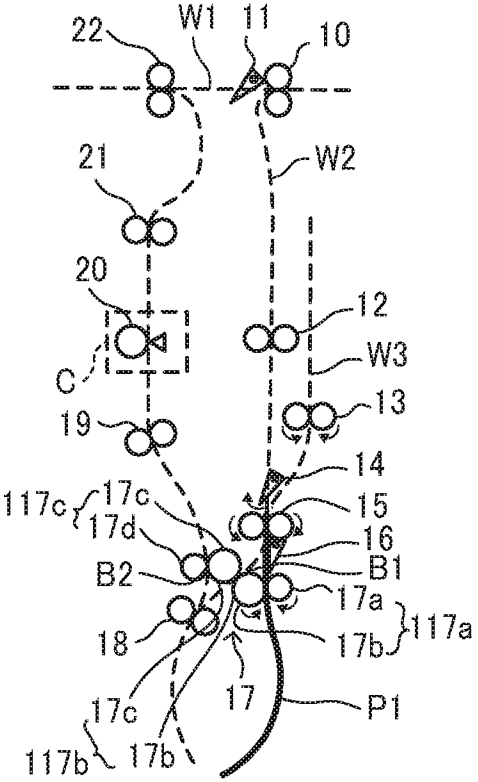
Figure 6C:
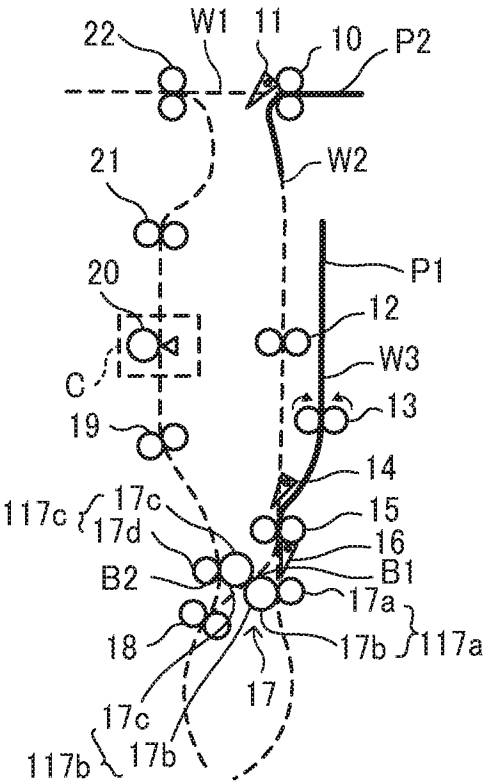

Next, the registration roller pair 15 and the first conveyance roller pair 117*a* serving as a first conveyance member including the first pressing roller 17*a* and the first folding roller 17*b* conveys the first sheet P1 in a predetermined direction, which is called a regular conveyance. Next, when the trailing edge of the first sheet P1 passes through the fork between the folding processing conveyance path W2 and the switchback conveyance path W3, the conveyance of the first sheet P1 is stopped. Next, the second bifurcating claw 14 pivots in the clockwise direction in FIG. 6B, and the posture of the second bifurcating claw 14 is switched to guide the first sheet P1 to the switchback conveyance path W3. Next, as illustrated in FIG. 6B, the registration roller pair 15, the first conveyance roller pair 117*a*, and the switchback conveying roller pair 13 rotate in reverse. This reverse rotation conveys the first sheet P1 in the reverse direction, and the first sheet P1 is conveyed to the switchback conveyance path W3. When the leading edge of the first sheet P1 in the regular conveyance that is the conveyance in the predetermined direction is conveyed to the switchback conveyance path W3, the switchback conveying roller pair 13 stops the conveyance of the first sheet P1. After stopping the conveyance of the first sheet P1, as illustrated in FIG. 6C, the switchback conveying roller pair 13 conveys the first sheet P1 in the predetermined direction that is a regular direction, strikes the leading edge of the first sheet P1 against the registration roller pair 15 to correct the skew, and puts the first sheet P1 on standby.

In this way, by conveying the preceding first sheet P1 to the switchback conveyance path W3 and withdrawing the preceding first sheet P1 from the folding processing conveyance path W2, the preceding first sheet P1 does not obstruct the conveyance of a following second sheet P2, thereby enabling smooth conveyances of the following sheet P2.

Figure 6D:
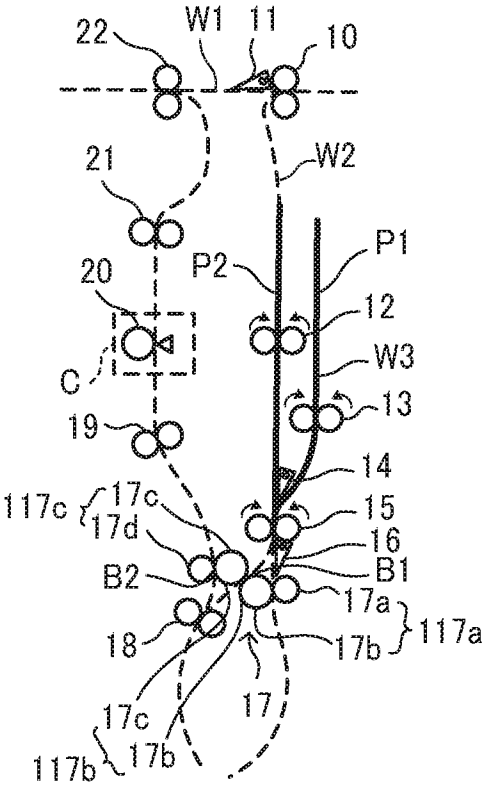
Figure 6E:
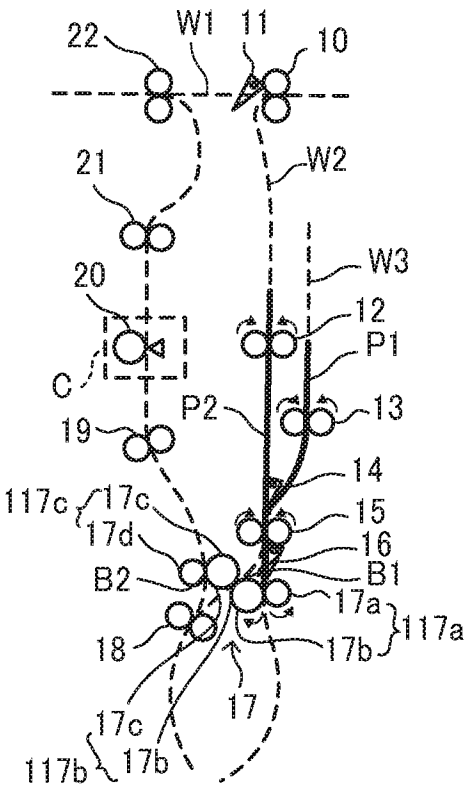
Figure 6F:
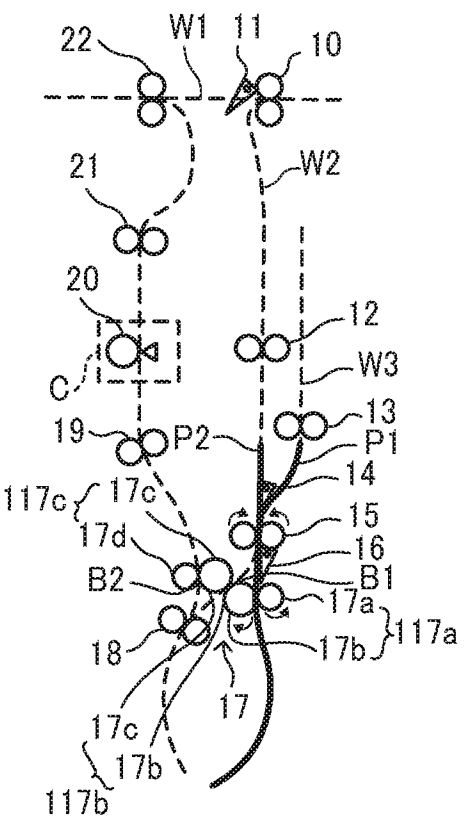

Next, a leading edge of the following second sheet P2 contacts the registration roller pair 15. As illustrated in FIG. 6D, even after the leading edge of the following sheet P2 contacts the registration roller pair 15, the conveyance roller pair 12 continues to convey the following sheet P2 and bends the following sheet P2 to correct the skew of the following sheet P2. As illustrated in FIG. 6E, after a predetermined time in which the following sheet P2 is bent by a predetermined amount has passed, the registration roller pair 15, the switchback conveying roller pair 13, and the first conveyance roller pair 117*a* rotate. As illustrated in FIG. 6F, the registration roller pair 15 conveys the first sheet P1 and the second sheet P2 in an overlaid manner.

When the number of overlaid sheets reaches the number set by the user, the folding section B starts the folding processing. On the other hand, when the number of overlaid sheets does not reach a number set by the user, the overlaid sheets are conveyed in the reverse direction when the trailing edge of the overlaid sheets has passed through the second bifurcating claw 14 and evacuates to the switchback conveyance path W3. The sheets are overlaid by repeating the above operation according to the number of sheets to be overlaid.

In the present embodiment, as described above, the skew of the following second sheet P2 is corrected without stopping the rotation of the conveyance roller pair 12, and the registration roller pair 15 starts to rotate when the bending amount of the second sheet P2 reaches the predetermined amount. Therefore, it is possible to overlay the preceding first sheet and the following second sheet without reducing productivity.

While the number of the overlaid sheets does not reach the number set by the user, an overlay process without the skew correction by the registration roller pair 15 may be performed, and, when the number of the overlaid sheets reaches the number set by the user, the overlay process with the skew correction by the registration roller pair 15 may be performed. In the overlay process with the skew correction, the switchback conveying roller pair 13 strikes the leading edge of the preceding sheet P1 or a preceding sheet bundle against the registration roller pair 15 to correct the skew and puts the sheet P1 or the preceding sheet bundle on standby, and, after the conveyance roller pair 12 strikes the leading edge of the following sheet P2 against the registration roller pair 15 to correct the skew, the registration roller pair 15 conveys the overlaid sheets. On the other hand, in the overlay process without the skew correction, the leading edge of the preceding sheet P1 or the sheet bundle is placed in the switchback conveyance path W3 and put on standby. Then, the switchback conveying roller pair 13 starts to convey the preceding sheet P1 or the preceding sheet bundle so that the preceding sheet P1 or the preceding sheet bundle placed on the switchback conveyance path W3 reaches the registration roller pair 15 when the following sheet P2 reaches the registration roller pair 15, and the sheets are overlaid. The registration roller pair 15 conveys the overlaid sheets.

FIGS. 7A to 7D are explanatory diagrams illustrating the general operation when the folding section B performs the Z-folding processing.

The leading edge of a sheet bundle Pt conveyed by the registration roller pair 15 after the overlay process enters the first conveyance roller pair 117*a* including the first folding roller 17*b* and the first pressing roller 17*a*. Next, when the sheet bundle Pt is conveyed by a predetermined conveyance amount Δ1, a drive motor to drive the folding mechanism 17 reversely rotates. A travel distance at this time is appropriately determined depending on the length of the sheet bundle Pt in the sheet conveyance direction and the content of the folding processing, such as the manner of folding.

Figure 7A:
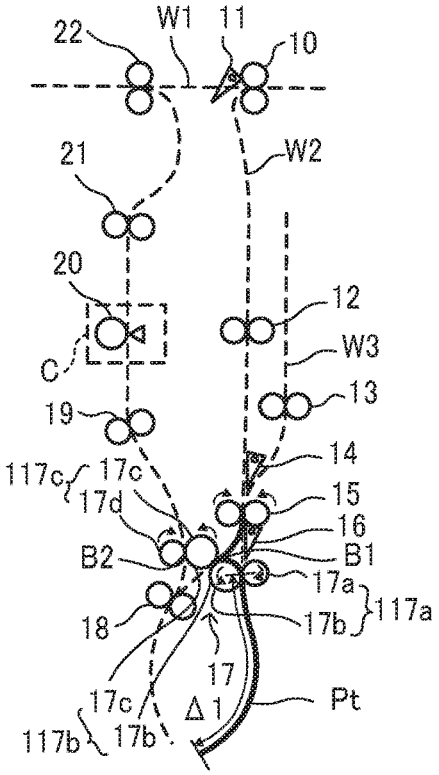
FIGS. 7A to 7D are explanatory diagrams illustrating a general operation when a folding section performs Z-folding processing.

Reverse rotation of the drive motor to drive the folding mechanism 17 conveys the sheet bundle Pt sandwiched by the first conveyance roller pair 117*a* in the reverse direction, that is, the direction opposite to the predetermined direction. This forms a bend in the sheet bundle portion between the registration roller pair 15 and the first conveyance roller pair 117*a* as illustrated in FIG. 7A. This bend, which is also called a folded-back portion, enters a nip between a first folding roller pair 117*b* including the first folding roller 17*b* and the second folding roller 17*c*, which forms the first folded portion in the folded-back portion. The first folded portion passing through the nip of the first folding roller 17*b* is conveyed toward the second conveyance roller pair 18 serving as a second conveyance member.

The first folded portion in the sheet bundle Pt enters the nip between the second conveyance roller pair 18. When the second conveyance roller pair 18 conveys the sheet bundle Pt by a predetermined conveyance amount Δ2, the second conveyance roller pair 18 reversely rotates and conveys the sheet bundle Pt sandwiched by the second conveyance roller pair 18 in the reverse direction that is the direction opposite to the predetermined direction. The conveyance amount Δ2 is appropriately determined depending on the length of the sheet bundle Pt in the sheet conveyance direction and a content of the folding processing such as folding manner.

Figure 7B:
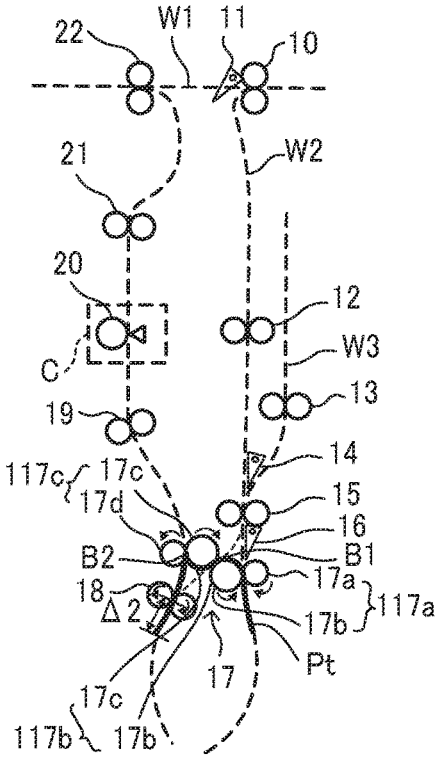

The conveyance of the sheet bundle Pt sandwiched by the second conveyance roller pair 18 in the reverse direction forms a bend in the sheet bundle between the first folding roller pair 117*b* and the second conveyance roller pair 18. As illustrated in FIG. 7B, this bend, which is also called a folded-back portion, enters a nip between a second folding roller pair 117*c* including the second folding roller 17*c* and the second pressing roller 17*d*, which forms the second folded portion in the folded-back portion.

Figure 7C:
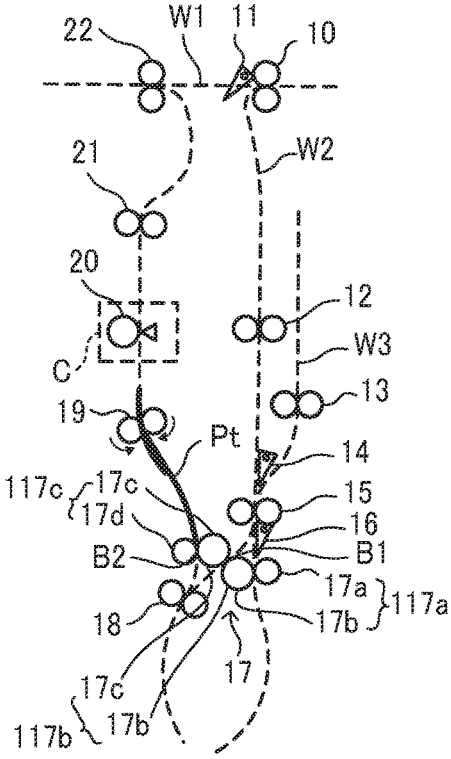
Figure 7D:
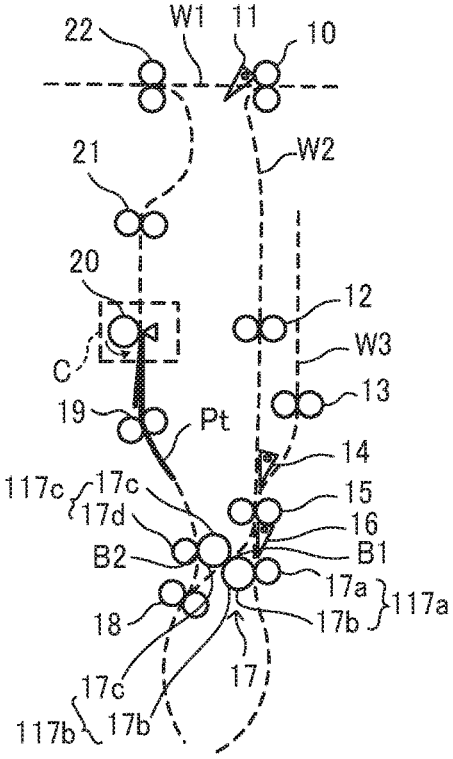

As illustrated in FIG. 7C, an intermediate conveyance roller pair 19 conveys the sheet bundle Pt including the two folded portions formed as described above, which has passed through the nip of the second folding roller pair 117*c*, toward the enhanced folding roller 20. As illustrated in FIG. 7D, when the second folded portion reaches the position opposed to the enhanced folding roller 20, the conveyance of the sheet bundle Pt is stopped. Next, the enhanced folding roller 20 rotates to put a sharp crease at the second folded portion, and the conveyance of the sheet bundle Pt is resumed. When the first folded portion reaches the position opposed to the enhanced folding roller 20, the conveyance of the sheet bundle Pt is stopped. The enhanced folding roller 20 rotates to put a sharp crease at the first folded portion, and the conveyance of the sheet bundle Pt is resumed. Two conveyance roller pairs 21 and 22 convey the sheet bundle Pt, and the conveyance roller pair 22 ejects the sheet bundle Pt to the post-processing apparatus 2.

In the above description, the sheet bundle Pt after the overlay process is folded. The folding process to fold one sheet is also the same. In the above description, Z folding-processing is described. The same operation as the Z-folding processing in which the conveyance amount Δ1 and the conveyance amount Δ2 are appropriately changed enables the inner three-fold and the outer three-fold to be carried out. In double folding processing, the third bifurcating claw 16 pivots in the clockwise direction in FIGS. 7A to 7D to adopt a posture for guiding the sheet to the first folding roller pair 117*b*, and the sheet conveyed from the registration roller pair 15 is conveyed to the first folding roller pair 117*b*. Then, the same operation as the above-described operation to form the second folded portion forms the folded portion at the center of the sheet in the conveyance direction, which enables double folding.

Figure 8:
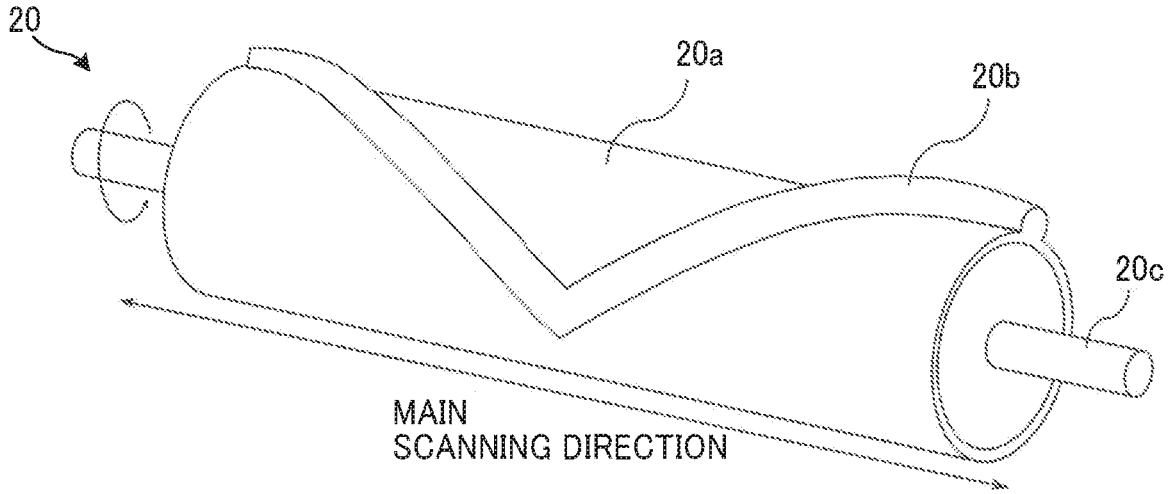
FIG. 8 is a perspective view of an enhanced folding roller.

FIG. 8 is a perspective view of the enhanced folding roller 20.

The enhanced folding roller 20 includes a convex shaped pressing portion 20*b* disposed on a circumferential surface of the pressing roller portion 20*a* with a certain angle difference from a rotation shaft 20*c* of the enhanced folding roller 20. The pressing portion 20*b* is arranged so that the pressing portion forms a V shape symmetrical about the center in the main scanning direction of the enhanced folding roller 20. This configuration of the enhanced folding roller 20 according to the present embodiment causes the pressing portion 20*b* to contact the folded portion of the sheet in two places at the same time. The pressing portion 20*b* is disposed in an area not more than half of the circumferential surface of the pressing roller portion 20*a* in the rotation direction.

In the above-described configuration of the pressing portion 20*b*, when the enhanced folding roller 20 is driven to rotate, the pressing portion 20*b* of the enhanced folding roller 20 sequentially presses the folded portion of the sheet P from the center of the sheet to the both ends of the sheet in the main scanning direction. This avoids the dispersion of the pressing force over the entire area of the folded portion in the main scanning direction in enhanced folding processing, and the pressing portion 20*b* can intensively apply the pressing force over the entire folded portion of the sheet. Therefore, even when the load applied to the enhanced folding member such as the enhanced folding roller 20 is small, it is possible to apply a desired pressing force to the folded portion of the sheet, and as compared with the case of pressing the entire area in the main scanning direction during the enhanced folding process, the load on the enhanced folding roller 20 can be reduced.

The above described enhanced folding can continuously press the folded portion of the sheet in the main scanning direction in a shorter time than enhanced folding processing in which a pressing roller moves from one end to the other end on the sheet in the main scanning direction and continuously presses the folded portion of the sheet in the main scanning direction. Therefore, the above described enhanced folding processing can improve productivity and apply enough pressing force to the folded portion of the sheet.

FIGS. 9A to 9F are explanatory diagrams illustrating a general operation when the enhanced folding section C performs the enhanced folding process.

Figure 9A:
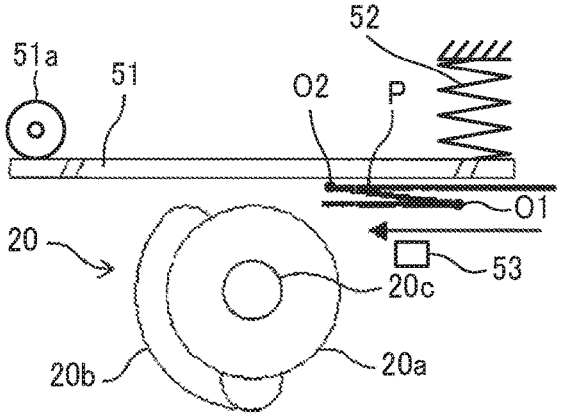
FIGS. 9A to 9F are explanatory diagrams illustrating a general operation when an enhanced folding section performs enhanced folding processing.

As illustrated in FIG. 9A, the enhanced folding section C includes a guide plate 51 opposite the enhanced folding roller 20 and a spring 52 to press the guide plate 51 toward the enhanced folding roller 20. The guide plate 51 is rotatably supported by a fulcrum 51*a* downstream in the sheet conveyance direction as a fulcrum, and the spring 52 contacts the upstream end portion of the guide plate 51 in the sheet conveyance direction.

Figure 9B:
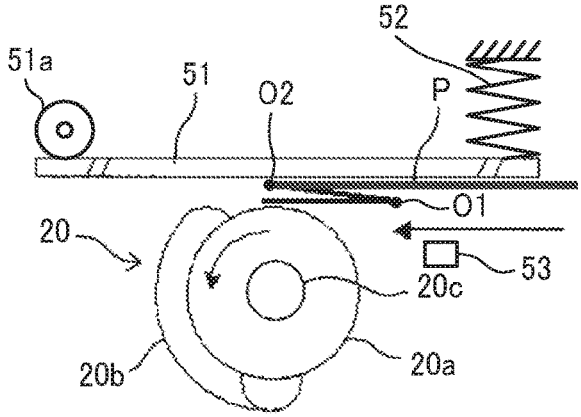

As illustrated in FIG. 9A, in the enhanced folding roller 20 on standby, a portion in which the pressing portion 20*b* is not formed faces the guide plate 51, and a gap is formed between the enhanced folding roller 20 and the guide plate 51. When the folded portion of the sheet P downstream in the sheet conveyance direction of the first folded portion O1 and the second folded portion O2 of the sheet P folded by the folding section B (that is, the second folded portion O2 in this example) reaches an enhanced folding position that is the nearest position to the rotation shaft 20*c* of the enhanced folding roller 20, the conveyance of the sheet is temporarily stopped as illustrated in FIG. 9B. As illustrated in FIGS. 9A to 9F, a sheet sensor 53 is disposed in front of the enhanced folding section C. When a predetermined time passes after the sheet sensor 53 detects the leading edge of the sheet P, the CPU 41 temporarily stops rotation of the conveyance roller pair such as the intermediate conveyance roller pair 19 that sandwiches and conveys the sheet P.

Figure 9C:
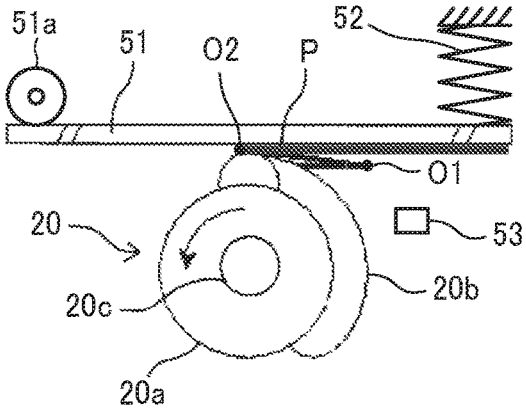

Next, the second motor controller 46 starts the enhanced folding motor 49 to rotate the enhanced folding roller 20. As a result, the second folded portion O2 of the sheet P is continuously pressed in both directions from the center in the main scanning direction in such a manner that the second folded portion O2 is sandwiched between the pressing portion 20*b* of the enhanced folding roller 20 and the guide plate 51 to put a sharp crease at the second folded portion O2 as illustrated in FIG. 9C.

In this operation example, the enhanced folding roller 20 starts to rotate after the sheet stops. However, the enhanced folding roller 20 may start to rotate without waiting for the sheet to stop so that the pressing portion 20*b* of the enhanced folding roller 20 contacts the folded portion of the sheet when the sheet P stops. The above-described control of the rotation of the enhanced folding roller 20 shortens the enhanced folding process time and improves productivity.

Figure 9D:
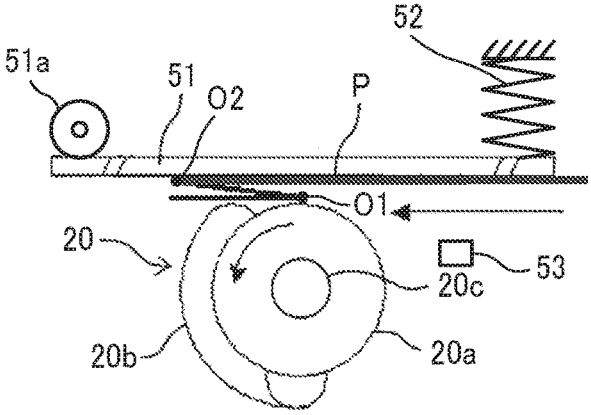

When the enhanced folding roller 20 is separated from the sheet P, the intermediate conveyance roller pair 19 again conveys the sheet P as illustrated in FIG. 9D. As described above, in the present embodiment, start of the conveyance of the sheet when the enhanced folding roller 20 is separated from the sheet without waiting stop of rotation of the enhanced folding roller 20 shortens the enhanced folding process time and improves productivity.

Figure 9E:
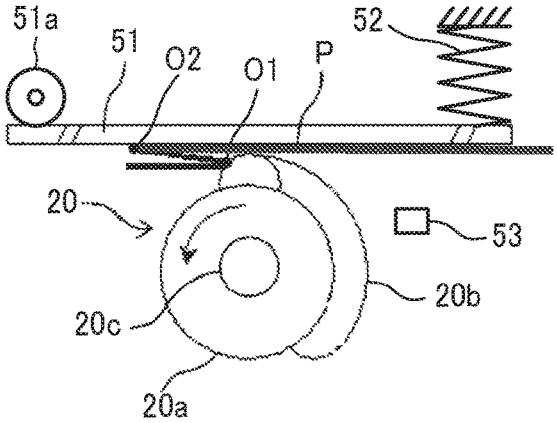
Figure 9F:
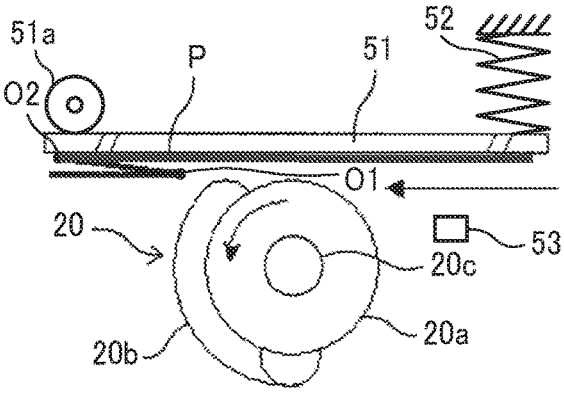

As illustrated in FIG. 9E, when the first folded portion O1 of the sheet P reaches the enhanced folding position, the intermediate conveyance roller pair 19 temporarily stops the conveyance of the sheet P, and the pressing portion 20*b* of the enhanced folding roller 20 continuously presses the first folded portion O1 of the sheet P from the center in the main scanning direction to the both ends in the main scanning direction. As illustrated in FIG. 9F, the intermediate conveyance roller pair 19 conveys the sheet P when the enhanced folding roller 20 separates from the sheet P. The above series of operations is basic operations of enhanced folding operations on the folded portion of the sheet P by the enhanced folding section C in the present embodiment.

In this operation example, after the second folded portion of the sheet is additionally folded, one rotation of the enhanced folding roller performs the enhanced folding process for the first folded portion of the sheet. However, after the second folded portion of the sheet is additionally folded, the rotation of the enhanced folding roller may be stopped and be rotated in a direction opposite to the rotating direction when the second folded portion is formed to perform the enhanced folding process for the first folded portion.

Figure 10:
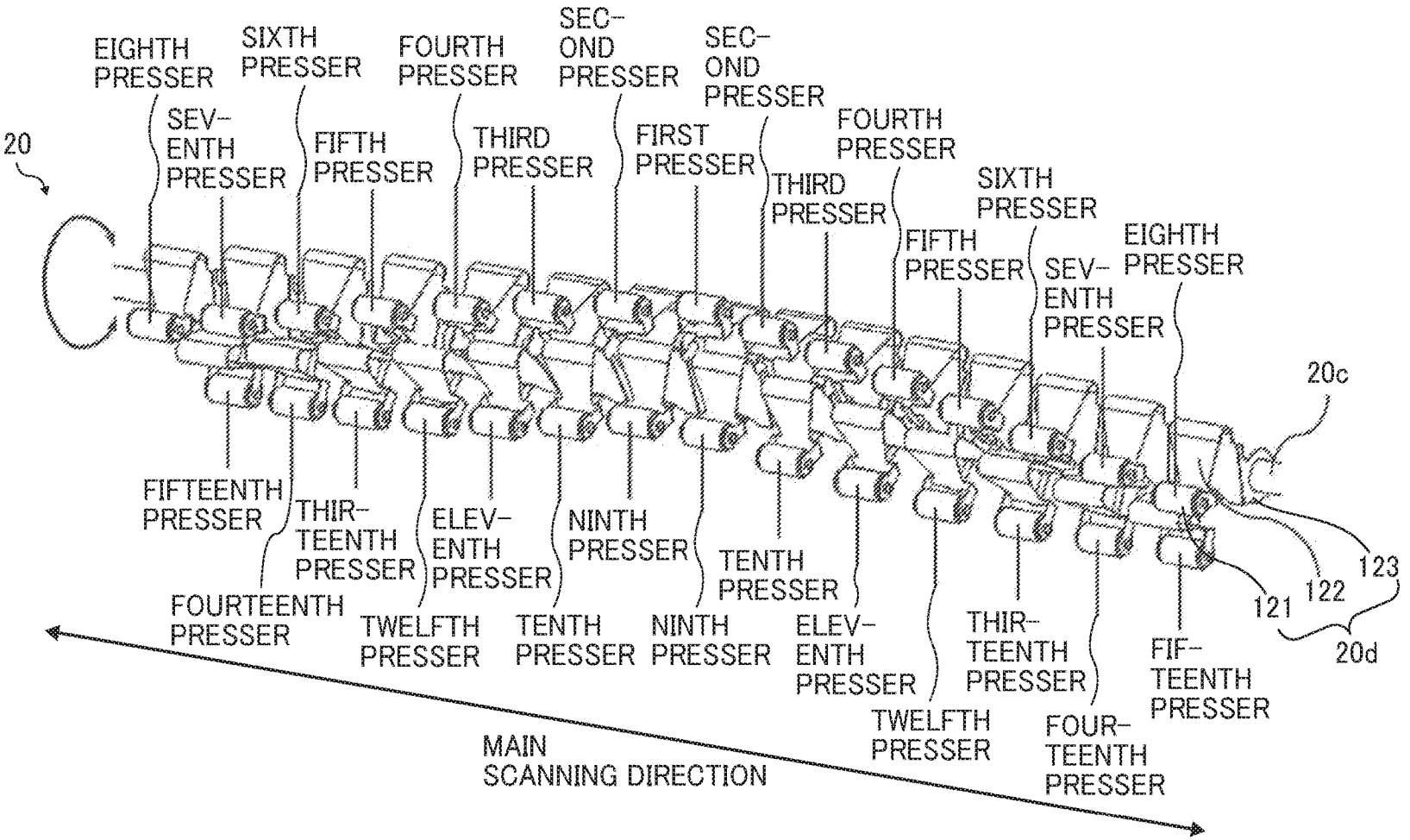
FIG. 10 is a perspective view illustrating a variation of the enhanced folding roller.

FIG. 10 is a perspective view illustrating a variation of the enhanced folding roller 20.

The enhanced folding roller 20 in the variation includes a plurality of pressers 20*d* disposed around the rotation shaft at a certain angular difference in the rotation direction of the rotation shaft 20*c* of the enhanced folding roller 20 and disposed at a certain interval in the main scanning direction.

Each presser 20*d* includes a fixing portion 123 to fix the presser on the rotation shaft 20*c*, a leaf spring 122, and a pressing roller 121 rotatably supported on a shaft parallel to the main scanning direction. The enhanced folding roller 20 of the variation has two presser groups disposed symmetrically about the center in the main scanning direction, each of which includes a plurality of pressers 20*d* disposed around the rotation shaft at a certain angular difference in the rotation direction of the rotation shaft 20*c* of the enhanced folding roller 20 and disposed at a certain interval in the main scanning direction. The first presser group includes from a first presser to an eighth presser in FIG. 25, and the second presser group includes from a ninth presser to a fifteenth presser in FIG. 25. In addition, the first presser group includes the presser positioning at a center of the two adjacent pressers of the second presser group in the rotation direction.

Since each presser 20*d* has the leaf spring 122, the guide plate 51 is fixed and not rotatable. When the pressing roller 121 cannot move in a vertical direction of the guide plate 51 because each presser 20*d* does not have the leaf spring 122, the guide plate 51 may be configured as illustrated in FIG. 9 to be rotatable.

In the variation, since the pressing rollers 121 serving as the pressing members are disposed around the rotation shaft with the certain angular difference in the rotation direction and disposed with the certain interval in the main scanning direction, the pressing rollers 121 can sequentially press the folded portion of the sheet P from the center of the sheet to the both ends of the sheet in the main scanning direction to put the sharp crease in the sheet P.

Next, a description is given of the detailed configuration of the sheet processing apparatus according to the present embodiment.

Figure 11:
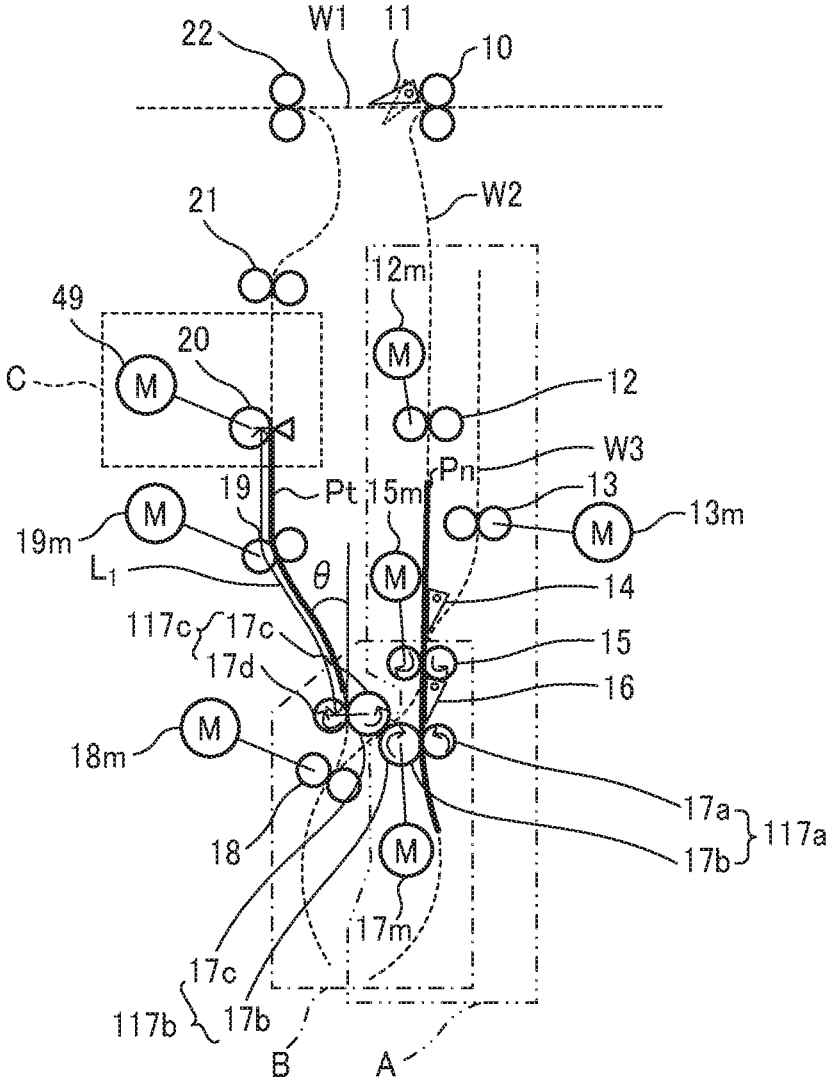
FIG. 11 is an explanatory diagram illustrating sheet conveyance of a second sheet during the enhanced folding process of a first sheet.

FIG. 11 is an explanatory diagram illustrating sheet conveyance of a second sheet during the enhanced folding process of a first sheet.

As illustrated in FIG. 11, in the present embodiment, a folding motor 17*m* drives the first pressing roller 17*a*, the first folding roller 17*b*, the second folding roller 17*c*, and the second pressing roller 17*d* of the folding mechanism 17. Therefore, when the trailing edge of the sheet does not pass through the second folding roller pair 117*c* during the enhanced folding operations, the enhanced folding operations must stop the driving of the folding motor 17*m*.

In addition, in the present embodiment, to reduce the size of the folding apparatus, the folding section B and the overlay section A share the same area extending from the registration roller pair 15 to the region downstream from the first conveyance roller pair 117*a*. Therefore, if the trailing edge of the sheet does not pass through the second folding roller pair 117*c* during the enhanced folding operations, overlay processing cannot be performed during the enhanced folding operations, which drastically reduces productivity.

However, in the present embodiment, a sheet conveyance distance L1 from the nip of the second folding roller pair 117*c* to the enhanced folding position in the enhanced folding section C is equal to or larger than the maximum sheet length after the folding processing. Specifically, the sheet conveyance distance L1 is longer than the length of the largest sheet folded in two that can be processed by the folding apparatus in the sheet conveyance direction. In the present embodiment, the sheet conveyance distance L1 is set to be about 300 mm. This allows the enhanced folding section C to perform the enhanced folding process on the folded portion of the sheet, regardless of the size of the sheet conveyed, in a state in which the trailing edge of the sheet pass through the second folding roller pair 117*c*.

In addition, in the present embodiment, the conveyance motors 12*m*, 13*m*, 15*m*, 18*m*, and 19*m* each drive the conveyance roller pair 12, the switchback conveying roller pair 13, the registration roller pair 15, the second conveyance roller pair 18, and the intermediate conveyance roller pair 19, respectively. The enhanced folding motor 49 drives the enhanced folding roller 20, and the folding motor 17*m* drives the folding mechanism 17. This enables independent control of each motor. Even if the conveyance of the sheet is stopped by stopping the drive of the intermediate conveyance roller pair 19, the other rollers can be driven and rotated to convey the sheet. In the present embodiment, in order to improve productivity, each of the entry roller pair 10, the conveyance roller pair 21 at an outlet of the folding processing conveyance path W2, and an output roller pair 22 has a conveyance motor that can independently drive each of them. Alternatively, a single motor that drives them all may be substituted for these separate motors.

As described above, in the present embodiment, when the enhanced folding section C performs the enhanced folding process on the folded portion of the sheet, the trailing edge of the sheet passes through the second folding roller pair 117*c*, and each roller pair can be independently driven. As a result, as illustrated in FIG. 11, during the enhanced folding operation, the folding motor 17*m* and the conveyance motor 15*m* are driven to rotate the registration roller pair 15 and the rollers 17*a*, 17*b*, 17*c*, and 17*d* of the folding mechanism 17 in directions of arrows in FIG. 11, which enables conveying the preceding sheet Pn for next overlay process to the switchback conveyance path W3. This enables to narrow a space between the sheets and improve productivity.

Figure 12:
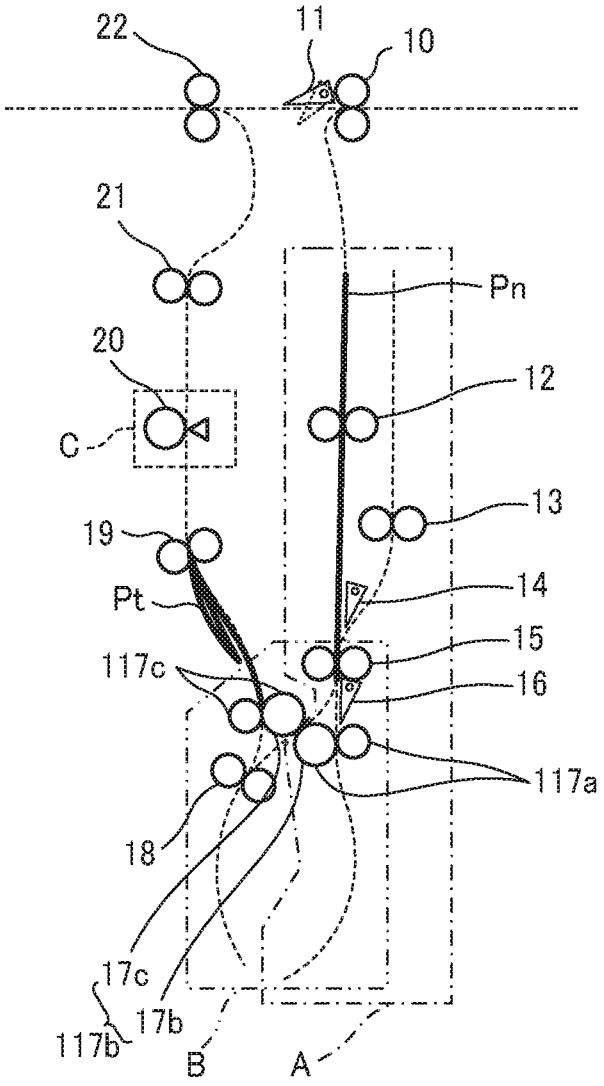
FIG. 12 is an explanatory diagram illustrating an example of a conveyance timing of the second sheet conveyed to the overlay section.

Additionally, as illustrated in FIG. 12, it is preferable that the preceding sheet Pn for the next overlay process is conveyed to the overlay section A before the trailing edge of the preceding sheet bundle Pt comes out of the nip of the second folding roller pair 117*c*. This enables starting conveyance control to convey the preceding sheet Pn to the switchback conveyance path W3 immediately after the trailing edge of the preceding sheet bundle Pt passes through the nip of the second folding roller pair 117*c*.

Alternatively, after the trailing edge of the preceding sheet bundle Pt comes out of the nip of the second folding roller pair 117*c*, the preceding sheet Pn for the next overlay process may be conveyed to the overlay section A. This enables performing switchback conveyance to convey the preceding sheet Pn for the next overlay process to the switchback conveyance path W3 when the folding mechanism 17 stops driving. This can prevent the preceding sheet Pn for the next overlay process from being conveyed to the first conveyance roller pair 117*a* before completion of switching of the first conveyance roller pair 117*a*.

Figure 13:
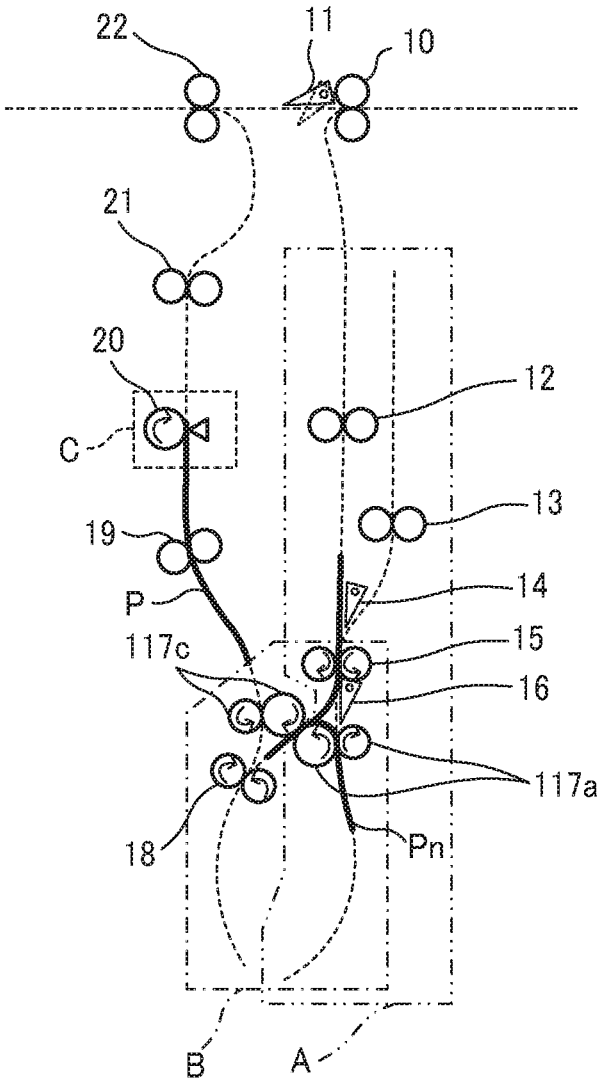
FIG. 13 is an explanatory diagram illustrating an example when one sheet is folded.

FIG. 13 is an explanatory diagram illustrating an example when one sheet is folded.

When performing the folding processing on one sheet, since the overlay processing is unnecessary, the sheet conveyed to the folding processing conveyance path W2 is subjected to the folding processing. In the present embodiment, since the trailing edge of the sheet P passes through the nip of the second folding roller pair 117*c* before the enhanced folding operation, during each enhanced folding operation, each roller in the folding processing section B can rotate as illustrated in FIG. 13 to perform the folding processing. This can improve productivity when one sheet is folded as compared with the case of performing the folding processing after the enhanced folding operation is completed.

In the above-described example, although the folding processing for one sheet is described, the folding processing for the sheet bundle can also start after the overlay processing without waiting for the end of the enhanced folding operation, thereby improving productivity.

In the present embodiment, the sheet conveyance distance L1 may not be longer than or equal to the maximum sheet length after the folding processing and may be longer than or equal to a length that is generally often used, such as a longer length of A4 size or letter size which are folded in two. Such a configuration enables downsizing of the apparatus and has an advantage in actual use because such configuration can improve productivity for commonly used sheets although such configuration cannot improve productivity for all sheets.

The configuration of the present embodiment, in which the trailing edge of the sheet passes through the nip of the second folding roller pair 117*c* before the enhanced folding process, lengthens the sheet conveyance distance L1 from the second folding roller pair 117*c* to the enhanced folding section C. Therefore, if the sheet conveyance direction from the folding processing section B to the enhanced folding section C is set to be substantially perpendicular to the sheet conveyance direction to the overlay section A (substantially downward direction), the folding apparatus 1 is enlarged in the horizontal direction. Or, if the sheet conveyance direction from the folding processing section B to the enhanced folding section C is set to be substantially same to the sheet conveyance direction to the overlay section A (substantially downward direction), the folding apparatus 1 is enlarged in the vertical direction.

Therefore, in the present embodiment, the sheet conveyance direction from the folding processing section B to the enhanced folding section C is set to be substantially opposite to the sheet conveyance direction to the overlay section A (substantially downward direction), that is, upward direction. This can form the sheet conveyance path from the folding processing section B to the enhanced folding section C next to the overlay section A, which prevents the folding apparatus 1 from enlarging, compared to the case when the sheet conveyance direction from the folding processing section B to the enhanced folding section C is set to be substantially perpendicular to the sheet conveyance direction to the overlay section A and substantially same to the sheet conveyance direction to the overlay section A.

The maximum angle θ in FIG. 11 in the sheet conveyance direction from the folding processing section B to the enhanced folding section C with respect to the conveyance direction to the overlay section A is within 30°, more preferably within 20°, still more preferably 10 or less. This prevents the folding apparatus 1 from enlarging in the horizontal direction.

The controller 40 may change the enhanced folding process based on the number of sheets overlaid.

Figure 14:
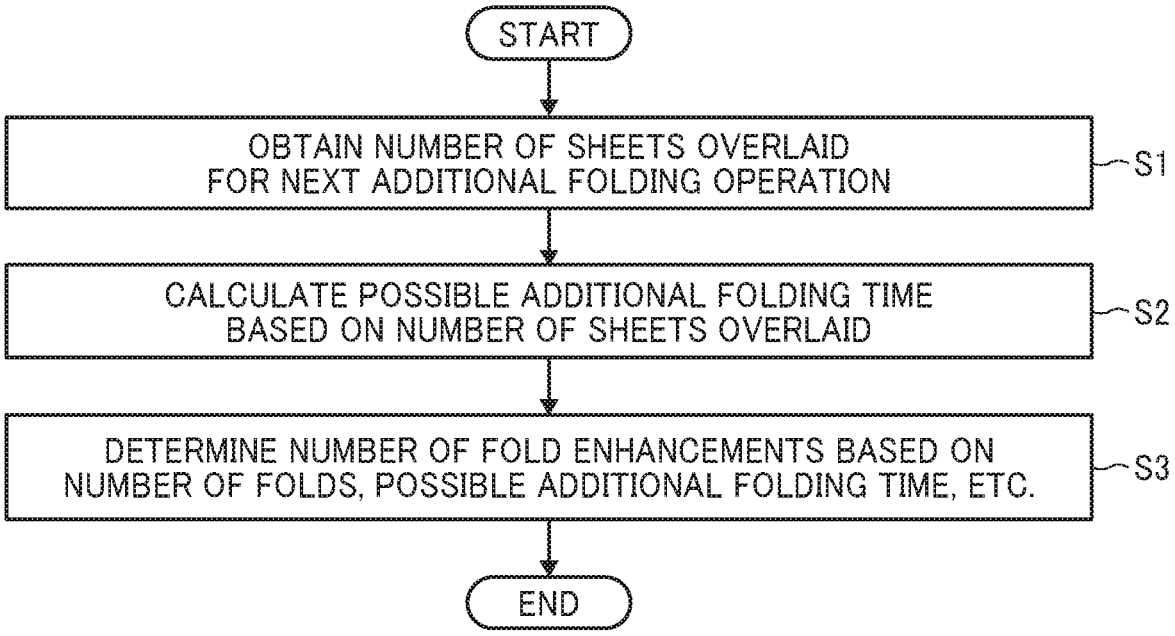
FIG. 14 is an example of a flowchart to determine a number of enhanced folding operations to a folded portion of the sheet in the enhanced folding process.

FIG. 14 is an example of a flowchart to determine the number of enhanced folding operations to the folded portion of the sheet in the enhanced folding process.

As illustrated in FIG. 14, the controller 40 obtains the number of sheets overlaid for the next enhanced folding operation in step S1. The controller 40 may obtain the number of sheets overlaid from a number set by the user who operates a control panel of the image forming apparatus. Next, the controller 40 calculates enhanced folding time for which the enhanced folding unit C may perform the enhanced folding process based on the number of sheets overlaid in step S2. As the number of overlaid sheets increases, time for the overlay processing in the overlay section A becomes longer, time until the next sheet bundle reaches the enhanced folding section C becomes longer, and time for the enhanced folding can be set longer.

Next, the controller 40 calculates how many times the enhanced folding section C may perform the enhanced folding operation on the folded portion of the sheet based on a number of the folded portion of the sheet bundle to be performed the enhanced folding process, time required for one enhanced folding operation, and time for movement from an end of the enhanced folding operation for one folded portion of the sheet to an arrival of the next folded portion of the sheet to the enhanced folding position and determines a number of times of the enhanced folding operations in step S3. When time that can be used for the enhanced folding operation is T1, the number of folded portion is n, the time required for one enhanced folding operation is T2, and the time for movement from an end of the enhanced folding operation for one folded portion of the sheet to an arrival of the next folded portion of the sheet to the enhanced folding position is t2, an example of the calculation formula can be expressed as follows:

$$\text{Number of enhanced folding operations}=\{T1-(t2\times(n-1))\}/(T2\times n)$$

When the number of overlaid sheets is small, the integer value of the calculated number of enhanced folding operations becomes "1", and one enhanced folding operation is performed on the folded portion of the sheet bundle. On the other hand, when the number of overlaid sheets is large and the time that can be used for the enhanced folding operation is long, the integer value of the calculated number of enhanced folding operations becomes "2" or more, and the enhanced folding operation can be performed a plurality of times. This enables to perform a plurality of times of the enhanced folding operations on the folded portion of the sheet bundle without lowering productivity and reduce the height of the folded portion.

In the above, the controller 40 changes the number of enhanced folding operations on the folded portion of the sheet bundle now based on the number of the sheets overlaid next time but may change a rotational speed of the enhanced folding roller 20 based on the number of the sheets overlaid next time. Slowing down the rotational speed of the enhanced folding roller 20 extends time when the pressing portion 20*b* presses the folded portion in the main scanning direction and enables to reduce the height of the folded portion. Therefore, when the number of overlaid sheets is large and the time that can be used for the enhanced folding operation is long, slowing down the rotational speed of the enhanced folding roller 20 can also reduce the height of the folded portion without reducing productivity.

Next, a description is given of variations of the present embodiment.

First Variation

Figure 15:
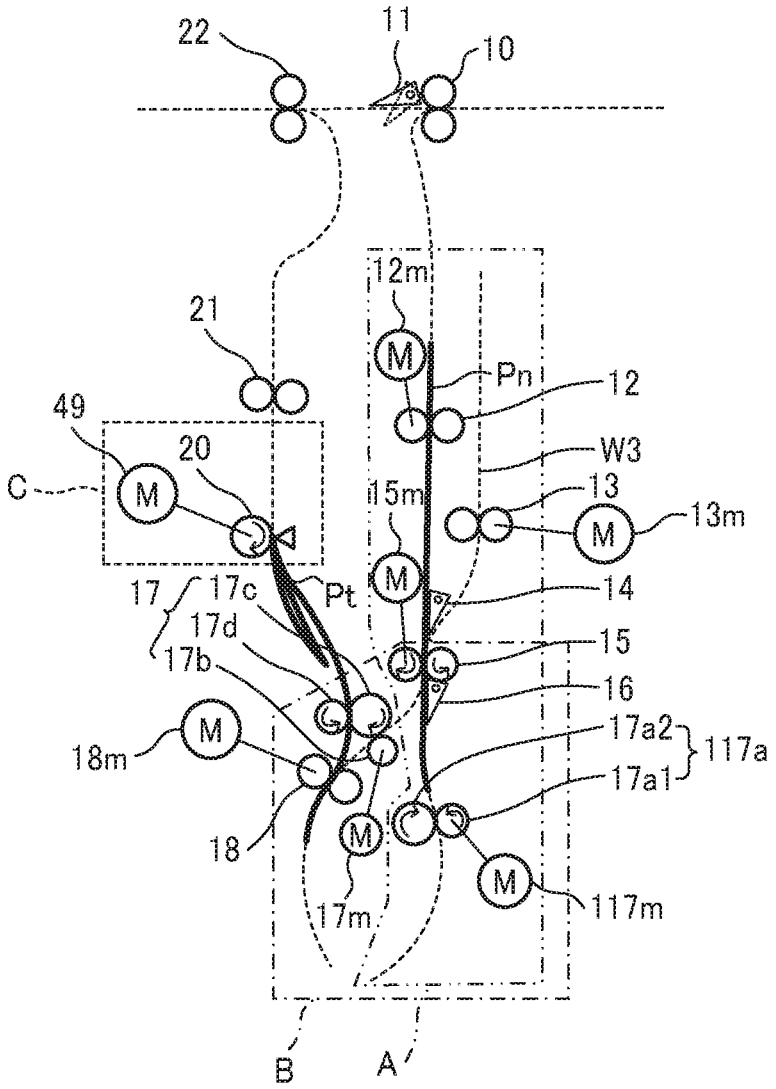
FIG. 15 is a schematic configuration diagram of a folding processing apparatus according to a first variation.

FIG. 15 is a schematic configuration diagram of a folding apparatus according to a first variation.

In the first variation, the first conveyance roller pair 117*a* is disposed separately from the folding mechanism 17, and the conveyance motor 117*m* is configured to be independently driven with respect to the folding mechanism 17. The above described configuration in which the first conveyance roller pair 117*a* can independently drive with respect to the folding mechanism 17 allows the switchback conveyance control in which the registration roller pair 15 and the first conveyance roller pair 117*a* drives to convey the preceding sheet to the switchback conveyance path W3 even when the second conveyance roller pair 18 and each of rollers 17*b*, 17*c*, and 17*d* in the folding mechanism 17 stop driving during the enhanced folding operation, and the conveyance of the sheet stops. In this configuration, if the trailing edge of the preceding sheet bundle Pt during the enhanced folding operation has exited the overlay section A, the overlay processing for the next sheet can be performed during the enhanced folding operation.

In the present embodiment, the first conveyance roller pair 117*a* and the registration roller pair 15 used for forming the first folded portion on the sheet are used for the switchback conveyance of the preceding sheet in the overlay processing. Therefore, at least, there is no problem if the trailing edge of the preceding sheet bundle Pt during the enhanced folding operation has exited the nip of the first folding roller pair 117*b*.

In the first variation, it may be possible to reduce a conveyance distance from the second folding roller pair 117*c* to the enhanced folding section C, and thereby, attain miniaturization of the folding apparatus. As compared to the configuration in the first variation, the configuration in the above-described present embodiment has a merit that the configuration in the above-described present embodiment can reduce the number of motors, that is, the number of parts, and the cost of the folding apparatus.

Second Variation

Figure 16:
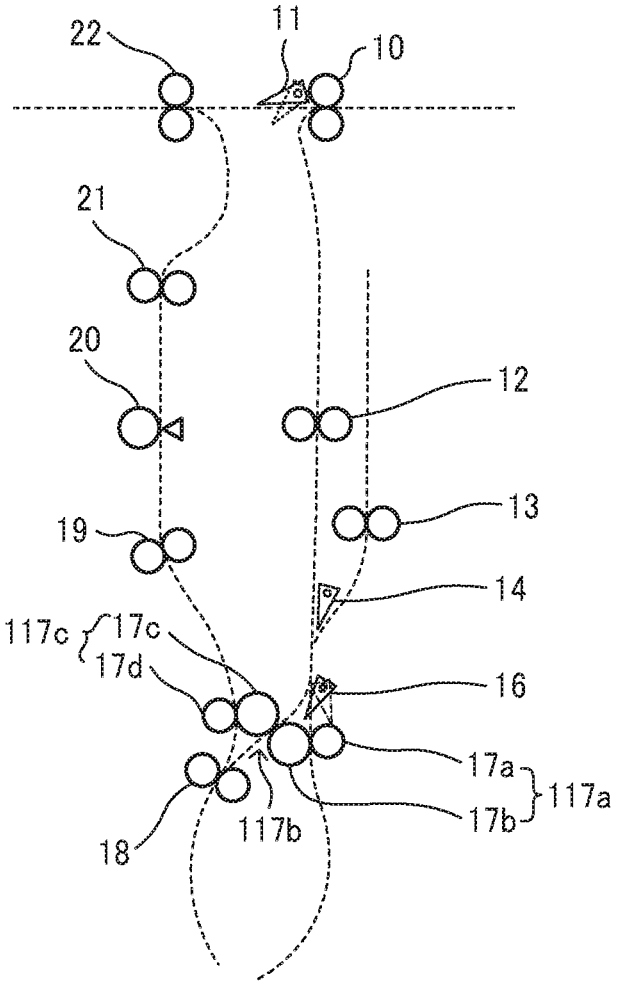
FIG. 16 is a schematic configuration diagram of a folding processing apparatus according to a second variation.

FIG. 16 is a schematic configuration diagram of a folding apparatus according to a second variation.

The folding processing apparatus in the second variation uses the first conveyance roller pair 117*a* including the first pressing roller 17*a* and the first folding roller 17*b* as the registration roller pair.

In the overlay processing, the preceding sheet P1 contacts the first conveyance roller pair 117*a* to correct the skew. After the skew is corrected, the first conveyance roller pair 117*a* conveys the preceding sheet P1 to the switchback conveyance path W3 in the same manner as described above. Subsequently, the leading edge of the preceding sheet P1 contacts the first conveyance roller pair 117*a* again and is held. Next, the following sheet P2 contacts the first conveyance roller pair 117*a* to correct the skew. Next, the preceding sheet P1 and the following sheet P2 are overlaid, and the first conveyance roller pair 117*a* rotates in the regular direction and conveys the sheet bundle of the preceding sheet P1 and the following sheet P2 in the regular direction by a predetermined conveyance amount. During the regular conveyance that is the conveyance in the regular direction, the bending of the preceding sheet P1 and the following sheet P2 is canceled. Specifically, the rotation speed of the first conveyance roller pair 117*a* that is a sheet conveyance speed moved by the first conveyance roller pair 117*a* is set to be higher than the rotation speed of the conveyance roller pair 12 and the switchback conveying roller pair 13 that is a sheet conveyance speed moved by the conveyance roller pair 12 and the switchback conveying roller pair 13, and this speed difference cancels the bending of the sheet bundle of the preceding sheet P1 and the following sheet P2 while the sheet bundle of the preceding sheet P1 and the following sheet P2 is conveyed by the predetermined conveyance amount.

After the sheet bundle is conveyed by the predetermined conveyance amount, with reference to FIG. 16, the third bifurcating claw 16 pivots from the position indicated by the dotted line to the position indicated by the solid line and pushes the folded-back portion of the sheet bundle toward the first folding roller pair 117*b*. At the same time, the first conveyance roller pair 117*a* rotates in the reverse direction to convey the sheet bundle in the reverse direction. This rotation bends the sheet bundle, and the bending portion of the sheet bundle enters the nip between the first folding roller pair 117*b*, which forms the first folded portion in the sheet bundle. After the first folded portion is formed, similarly to the above, the first folded portion is conveyed to the second conveyance roller pair 18. The second conveyance roller pair 18 conveys the sheet bundle in the regular direction by a predetermined conveyance amount and conveys in the reverse direction. This forms the bend in the sheet bundle between the first folding roller pair 117*b* and the second conveyance roller pair 18, and the bend that is the folded-back portion enters the nip between the second folding roller pair 117*c* to form the second folded portion.

In the second variation, the overlay processing and the folding processing for the next sheet can be also performed during the enhanced folding process because the trailing edge of the sheet during the enhanced folding operation has exited the nip between the second folding roller pair 117*c*.

The embodiments described above are but examples and provide the following advantages from a first aspect to a fourteenth aspect.

First Aspect

In a first aspect, a sheet processing apparatus includes a folding device such as the folding section B to fold the sheet and an fold-enhancing device such as the enhanced folding section C to press a folded portion of the sheet folded by the folding device to perform enhanced folding processing on the sheet whose trailing edge has exited the folding device.

The sheet processing apparatus in which the trailing edge of the sheet during the enhanced folding operation is in the folding section cannot convey the next sheet to the folding section, as long as the enhanced folding is completed, and as long as the trailing edge of the sheet does not go out of the folding section. Therefore, productivity is low.

On the other hand, in the first aspect, since the trailing edge of the sheet during the enhanced folding operation has exited the folding section, the next sheet can be conveyed to the folding section, and the folding processing on the next sheet can be started. This improves productivity compared to the above-described sheet processing apparatus.

Second Aspect

In a second aspect, the sheet processing apparatus according to the first aspect includes a circuitry such as the controller 40 to control the folding device such as the folding section B and the fold-enhancing device such as the enhanced folding section C, and, while the circuitry controls the fold-enhancing device to perform the enhanced folding process on the sheet, the circuitry controls the folding device to fold a next sheet.

As described in the embodiment, this can improve productivity as compared with the sheet processing apparatus that performs the folding processing for the next sheet after the enhanced folding operation.

Third Aspect

In a third aspect, the sheet processing apparatus according to the first aspect includes an overlay device such as the overlay section A to overlay a plurality of sheets sent sequentially, form a sheet bundle, and convey the sheet bundle to the folding device such as the folding section B and circuitry such as the controller 40 to control the folding device and the overlay device; and the circuitry controls the overlay device to receive a sheet subsequent to the plurality of sheets before the trailing edge of the sheet bundle has exited the folding device.

As described in the embodiment, this enables performing the overlay processing, that is, a control in the present embodiment to convey the preceding sheet to the switchback conveyance path W3 when the trailing edge of the sheet has exited the folding device such as the folding section B, which improves productivity.

Fourth Aspect

In a fourth aspect, the sheet processing apparatus according to the first aspect includes an overlay device such as the overlay section A to overlay a plurality of sheets sent sequentially, form a sheet bundle, and convey the sheet bundle to the folding device such as the folding section B and circuitry such as the controller 40 to control the folding device and the overlay device and control the overlay device to receive a sheet subsequent to the plurality of sheets after the trailing edge of the sheet bundle has exited the folding device.

As described in the embodiment, this enables performing the overlay processing, that is, a control in the present embodiment to convey the preceding sheet to the switchback conveyance path W3 when the folding mechanism 17 perfectly stops driving.

Fifth Aspect

In a fifth aspect, a sheet processing apparatus includes an overlay device such as the overlay section A to overlay a plurality of sheets sent sequentially and form a sheet bundle. The overlay device includes a holder such as the switchback conveyance path W3 branching from a sheet conveyance path such as the folding processing conveyance path W2, conveys a preceding sheet in the predetermined direction, subsequently conveys the preceding sheet in a direction opposite to the predetermined direction, and holds the preceding sheet in the holder. The sheet processing apparatus in the fifth aspect includes a folding device such as the folding section B to fold the sheet bundle sent from the overlay device and an fold-enhancing device such as the enhanced folding section C to press a folded portion of the sheet bundle folded by the folding device to perform the enhanced folding process on the sheet bundle whose trailing edges are out of the overlay device.

As described in the first variation, this can improve productivity because the overlay device can overlay the next sheet while the fold-enhancing device performs the enhanced folding operation on the sheet bundle. Additionally, this can reduce the size of the sheet processing apparatus because the conveyance distance from the folding device such as the folding section B to the fold-enhancing device such as the enhanced folding section C in the sheet processing apparatus of the fifth aspect can be set smaller than that in the sheet processing apparatus in which the trailing edge of the sheet during the enhanced folding operation has exited the fold-enhancing device.

Sixth Aspect

In a sixth aspect, a sheet processing apparatus includes an overlay device such as the overlay section A to overlay a plurality of sheets sent sequentially and form a sheet bundle. The overlay device includes a holder such as the switching conveyance path W3 branching from a sheet conveyance path such as the folding processing conveyance path W2. The sheet processing apparatus according to the sixth aspect includes a folding device such as the folding processing section B to fold the sheet bundle sent from the overlay device. The folding device includes a conveyor such as the registration roller pair 15 to convey the sheet bundle, a reversible conveyer such as the first conveyance roller pair 117*a* rotatable in reverse to convey the sheet bundle conveyed from the conveyer, and a folded portion former such as the first folding roller pair 117*b* to form a folded portion on the sheet bundle. The sheet processing apparatus according to the sixth aspect includes an fold-enhancing device such as the enhanced folding section C to press the folded portion of the sheet bundle processed by the folding device to perform the enhanced folding process and circuitry such as the controller 40 to control the overlay device, the folding device, and the fold-enhancing device. The circuitry controls the reversible conveyer to convey the sheet bundle held by the conveyer and the reversible conveyer to the conveyer, bend the sheet bundle, and enter a bent portion of the sheet bundle into the folded portion former to fold the sheet bundle. The circuitry controls the overlay device to convey a preceding sheet to the folding device by a predetermined amount in the predetermined direction, subsequently convey the preceding sheet in a direction opposite to the predetermined direction, and convey the preceding sheet to the holder to hold the preceding sheet in the holder. The circuitry controls the fold-enhancing device to perform the enhanced folding process on the sheet bundle after a trailing edge of the sheet bundle has exited a portion in which the preceding sheet exists in the folding device when the overlay device overlays a plurality of sheets.

As described in the first variation, this can improve productivity because the overlay device can overlay the next sheet while the fold-enhancing device performs the enhanced folding operation on the sheet bundle. Additionally, this can reduce the size of the sheet processing apparatus because the conveyance distance from the folding device such as the folding section B to the fold-enhancing device such as the enhanced folding section C in the sheet processing apparatus of the fifth aspect can be set smaller than that in the sheet processing apparatus in which the trailing edge of the sheet during the enhanced folding operation has exited the fold-enhancing device.

Furthermore, setting a portion in which the preceding sheet is conveyed by the predetermined amount in the predetermined direction that is the regular direction when the preceding sheet is conveyed to the holder in the folding device can lead the size of the sheet processing apparatus smaller than setting the portion in which the preceding sheet is conveyed by the predetermined amount in the predetermined direction that is the regular direction in a place other than the folding device.

Seventh Aspect

In a seventh aspect, the sheet processing apparatus according to the fifth aspect includes circuitry such as the controller 40 to control the overlay device such as the overlay section A and the fold-enhancing device such as the enhanced folding section C to overlay the plurality of sheets when the fold-enhancing device performs the enhanced folding process on the sheet bundle.

As described in the first variation, this improves productivity.

Eighth aspect In an eighth aspect, the folding device such as the folding section B of the sheet processing apparatus according to the first aspect forms two folded portion in either a sheet bundle or the sheet.

As described in the embodiment, this makes it possible to perform the Z folding-processing, the inner three-fold, and the outer three-fold to either the sheet bundle or the sheet.

Ninth Aspect

In a ninth aspect, the sheet processing apparatus according to the first aspect includes an overlay device such as the overlay section A to overlay a plurality of sheets sent sequentially, form a sheet bundle, and convey the sheet bundle to the folding device such as the folding section B and circuitry such as the controller 40 to control the overlay device and the fold-enhancing device to determine a number of present enhanced folding operations based on a number of sheets of the sheet bundle conveyed to the fold-enhancing device for next enhanced folding processing.

As described in the embodiment, as the number of sheets of the sheet bundle conveyed to the fold-enhancing device for next enhanced folding processing increases, time for the overlay processing by the overlay device such as the overlay section A becomes longer, and time to convey the next sheet bundle to the enhanced folding section C becomes longer.

The sheet processing apparatus according to the ninth aspect that determines the number of present enhanced folding operations based on the number of sheets of the sheet bundle conveyed to the fold-enhancing device for next enhanced folding processing can increase the number of enhanced folding operations when the number of sheets of the sheet bundle conveyed to the fold-enhancing device for next enhanced folding processing is large, which enables to reduce the height of the folded portion without lowering productivity.

Tenth Aspect

In a tenth aspect, the sheet processing apparatus according to the first aspect includes an overlay device such as the overlay section A to overlay a plurality of sheets sent sequentially, form a sheet bundle, and convey the sheet bundle to the folding device such as the folding section B and circuitry such as the controller 40 to control the overlay device and the fold-enhancing device such as the enhanced folding section C to determine an enhanced folding speed of present enhanced folding processing based on a number of sheets of the sheet bundle conveyed to the fold-enhancing device for next enhanced folding processing.

In the tenth aspect, as in the ninth aspect, it is possible to reduce the height of the folded portion without lowering productivity.

Eleventh Aspect

In an eleventh aspect, the sheet processing apparatus according to the first aspect includes an overlay device such as the overlay section A to overlay a plurality of sheets sent sequentially, form a sheet bundle, and convey the sheet bundle to the folding device such as the folding section B, and the sheet conveyance direction in the fold-enhancing device is opposite to the sheet conveyance direction in the overlay device.

As described in the embodiment, this can reduce the size of the sheet processing apparatus.

Twelfth Aspect

In a twelfth aspect, the fold-enhancing device such as the enhanced folding section C of the sheet processing apparatus according to the first aspect includes an enhanced folding member such as the enhanced folding roller 20 rotatable about a rotational axis. The enhanced folding member includes a presser such as the pressing portion 20*b* and the presser 20*d* disposed in a predetermined range in a rotational axis direction and disposed at a different position in a rotation direction to press either a sheet bundle or the sheet.

As described in the embodiment, the presser of the enhanced folding member such as the enhanced folding roller 20 sequentially presses the folded portion of the sheet P in the main scanning direction. This avoids the dispersion of the pressing force over the entire area of the folded portion in the main scanning direction in enhanced folding processing, and the presser can intensively apply the pressing force over the entire folded portion of the sheet. Therefore, even when the load applied to the enhanced folding member is small, it is possible to apply a desired pressing force to the folded portion of the sheet, and as compared with the case of pressing the entire area in the main scanning direction during the enhanced folding process, the load on the enhanced folding member can be reduced.

Thirteenth Aspect

In a thirteenth aspect, the folding device such as the folding section B of the sheet processing apparatus according to the first aspect includes a conveyor such as the registration roller pair 15 to convey either the sheet bundle or the sheet, a reversible conveyer such as the first conveyance roller pair 117*a* rotatable in reverse to convey either the sheet bundle or the sheet conveyed from the conveyer, and a folded portion former such as the first folding roller pair 117*b* to form a folded portion on either the sheet bundle or the sheet, and the sheet processing apparatus includes circuitry such as the controller 40 to control the overlay device and the folding device. The circuitry controls the reversible conveyer to convey the sheet bundle held by the conveyer and the reversible conveyer to the conveyer, bend the sheet bundle, and enter a bent portion of the sheet bundle into the folded portion former to fold the sheet bundle.

This enables to fold the sheet or the sheet bundle while conveying the sheet, which reduces the size of the sheet processing apparatus and improve productivity.

Fourteenth Aspect

In a fourteenth aspect, an image forming system includes an image forming apparatus such as the image forming apparatus 3 to form an image on a sheet and the sheet processing apparatus such as the folding apparatus 1 according to the first aspect to perform predetermined processing on the sheet.

This improves productivity.

Numerous additional modifications and variations are possible in light of the above teachings. It is therefore to be understood that, within the scope of the above teachings, the present disclosure may be practiced otherwise than as specifically described herein. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a folding device to fold a sheet;

a fold-enhancing device to press a folded portion of the sheet folded by the folding device to perform enhanced folding processing on the sheet, a trailing edge of the sheet having exited the folding device; and circuitry to control the fold-enhancing device to perform the enhanced folding processing on the sheet, and to control the folding device to fold a next sheet while the circuitry controls the fold enhancing device.

2. The sheet processing apparatus of claim 1, further comprising:

an overlay device to overlay a plurality of sheets sent sequentially, to form a sheet bundle, and to convey the sheet bundle to the folding device; and circuitry to control the folding device and to control the overlay device;

to receive a sheet subsequent to the plurality of sheets after a trailing edge of the sheet bundle exits the folding device.

3. The sheet processing apparatus of claim 1, wherein the folding device is configured to form two folded portions in either a sheet bundle or the sheet.

4. The sheet processing apparatus of claim 1, further comprising:

an overlay device to overlay a plurality of sheets sent sequentially, to form a sheet bundle, and to convey the sheet bundle to the folding device; and circuitry to control the overlay device and the fold-enhancing device to determine a number of present enhanced folding operations based on a number of sheets of the sheet bundle conveyed to the fold-enhancing device for next enhanced folding processing.

5. The sheet processing apparatus of claim 1, further comprising:

an overlay device to overlay a plurality of sheets sent sequentially, to form a sheet bundle, and to convey the sheet bundle to the folding device; and circuitry to control the overlay device and the fold-enhancing device to determine an enhanced folding speed of present enhanced folding processing based on a number of sheets of the sheet bundle conveyed to the fold-enhancing device for next enhanced folding processing.

6. The sheet processing apparatus of claim 1, wherein the fold-enhancing device includes an enhanced folding member rotatable about a rotational axis, the enhanced folding member including a presser disposed in a range in a rotational axis direction and disposed at a different position in a rotation direction, to press either a sheet bundle or the sheet.

7. The sheet processing apparatus of claim 1, further comprising circuitry to control the folding device, wherein the folding device includes a conveyor to convey either a sheet bundle or the sheet;

a reversible conveyer rotatable in reverse to convey either the sheet bundle or the sheet conveyed from the conveyer; and a folded portion former to form a folded portion on either the sheet bundle or the sheet; and wherein the circuitry is configured to control the reversible conveyer to convey the sheet bundle, held by the conveyer and the reversible conveyer, to the conveyer, bend the sheet bundle, and enter a bent portion of the sheet bundle into the folded portion former to fold the sheet bundle.

8. An image forming system comprising:

an image forming apparatus to form an image on a sheet; and the sheet processing apparatus of claim 1 to perform processing on the sheet.

9. A sheet processing apparatus comprising:

a folding device to fold a sheet;

a fold-enhancing device to press a folded portion of the sheet folded by the folding device to perform enhanced folding processing on the sheet, a trailing edge of the sheet having exited the folding device;

an overlay device to overlay a plurality of sheets sent sequentially, to form a sheet bundle, and to convey the sheet bundle to the folding device; and circuitry to control the folding device and to control the overlay device to receive a sheet subsequent to the plurality of sheets, before a trailing edge of the sheet bundle exits the folding device.

10. The sheet processing apparatus of claim 9, wherein the folding device is configured to form two folded portion in either a sheet bundle or the sheet.

11. The sheet processing apparatus of claim 9, further comprising:

an overlay device to overlay a plurality of sheets sent sequentially, to form a sheet bundle, and to convey the sheet bundle to the folding device; and circuitry to control the overlay device and the fold-enhancing device to determine a number of present enhanced folding operations based on a number of sheets of the sheet bundle conveyed to the fold-enhancing device for next enhanced folding processing.

12. The sheet processing apparatus of claim 9, further comprising:

an overlay device to overlay a plurality of sheets sent sequentially, to form a sheet bundle, and to convey the sheet bundle to the folding device; and circuitry to control the overlay device and the fold-enhancing device to determine an enhanced folding speed of present enhanced folding processing based on a number of sheets of the sheet bundle conveyed to the fold-enhancing device for next enhanced folding processing.

13. The sheet processing apparatus of claim 9, further comprising:

an overlay device to overlay a plurality of sheets sent sequentially, to form a sheet bundle, and to convey the sheet bundle to the folding device, wherein a sheet conveyance direction, in which the sheet bundle folded by the folding device is conveyed to the fold-enhancing device, is opposite to a sheet conveyance direction in which the plurality of sheets is sent to the overlay device.

14. The sheet processing apparatus of claim 9, wherein the fold-enhancing device includes an enhanced folding member rotatable about a rotational axis, the enhanced folding member including a presser disposed in a range in a rotational axis direction and disposed at a different position in a rotation direction to press either a sheet bundle or the sheet.

15. The sheet processing apparatus of claim 9, further comprising circuitry to control the folding device, wherein the folding device includes a conveyor to convey either a sheet bundle or the sheet;

a reversible conveyer rotatable in reverse to convey either the sheet bundle or the sheet conveyed from the conveyer; and a folded portion former to form a folded portion on either the sheet bundle or the sheet; and wherein the circuitry is configured to control the reversible conveyer to convey the sheet bundle held by the conveyer and the reversible conveyer to the conveyer, bend the sheet bundle, and enter a bent portion of the sheet bundle into the folded portion former to fold the sheet bundle.

16. An image forming system comprising:

an image forming apparatus to form an image on a sheet; and the sheet processing apparatus of claim 9 to perform processing on the sheet.

17. A sheet processing apparatus comprising:

a folding device to fold a sheet;

a fold-enhancing device to press a folded portion of the sheet folded by the folding device to perform enhanced folding processing on the sheet, a trailing edge of the sheet having exited the folding device; and an overlay device to overlay a plurality of sheets sent sequentially, to form a sheet bundle, and to convey the sheet bundle to the folding device, wherein a sheet conveyance direction, in which the sheet bundle folded by the folding device is conveyed to the fold-enhancing device, is opposite to a sheet conveyance direction in which the plurality of sheets are sent to the overlay device.

18. The sheet processing apparatus of claim 17, further comprising:

an overlay device to overlay a plurality of sheets sent sequentially, to form a sheet bundle, and to convey the sheet bundle to the folding device; and circuitry to control the folding device and the overlay device, wherein the circuitry is configured to control the overlay device to receive a sheet subsequent to the plurality of sheets after the trailing edge of the sheet bundle exits the folding device.

19. The sheet processing apparatus of claim 17, wherein the folding device is configured to form two folded portion in either a sheet bundle or the sheet.

20. The sheet processing apparatus of claim 17, further comprising:

an overlay device to overlay a plurality of sheets sent sequentially, to form a sheet bundle, and to convey the sheet bundle to the folding device; and circuitry to control the overlay device and the fold-enhancing device to determine a number of present enhanced folding operations based on a number of sheets of the sheet bundle conveyed to the fold-enhancing device for next enhanced folding processing.

21. The sheet processing apparatus of claim 17, further comprising:

an overlay device to overlay a plurality of sheets sent sequentially, to form a sheet bundle, and to convey the sheet bundle to the folding device; and circuitry to control the overlay device and the fold-enhancing device to determine an enhanced folding speed of present enhanced folding processing based on a number of sheets of the sheet bundle conveyed to the fold-enhancing device for next enhanced folding processing.

22. The sheet processing apparatus of claim 17, wherein the fold-enhancing device includes an enhanced folding member rotatable about a rotational axis, the enhanced folding member including a presser disposed in a range in a rotational axis direction and disposed at a different position in a rotation direction to press either a sheet bundle or the sheet.

23. The sheet processing apparatus of claim 17, further comprising circuitry to control the folding device, wherein the folding device includes a conveyor to convey either a sheet bundle or the sheet;

a reversible conveyer rotatable in reverse to convey either the sheet bundle or the sheet conveyed from the conveyer; and a folded portion former to form a folded portion on either the sheet bundle or the sheet; and wherein the circuitry is configured to control the reversible conveyer to convey the sheet bundle held by the conveyer and the reversible conveyer to the conveyer, bend the sheet bundle, and enter a bent portion of the sheet bundle into the folded portion former to fold the sheet bundle.

24. An image forming system comprising:

an image forming apparatus to form an image on a sheet; and the sheet processing apparatus of claim 17 to perform processing on the sheet.

25. A sheet processing apparatus comprising:

an overlay device to overlay a plurality of sheets sent sequentially and to form a sheet bundle, the overlay device including a holder branching from a sheet conveyance path, and the overlay device being configured to convey a preceding sheet in a direction, and to subsequently convey the preceding sheet in a direction opposite to the direction, and to hold the preceding sheet in the holder;

a folding device to fold the sheet bundle sent from the overlay device; and a fold-enhancing device to press a folded portion of the sheet bundle folded by the folding device to perform an enhanced folding processing on the sheet bundle, trailing edges of the sheet bundle having exited the overlay device.

26. The sheet processing apparatus of claim 25, further comprising:

circuitry to control the overlay device and to control the fold-enhancing device to overlay the plurality of sheets when the fold-enhancing device performs the enhanced folding processing on the sheet bundle.

* * * * *